US007301457B2

(12) United States Patent
Houston

(10) Patent No.: US 7,301,457 B2
(45) **Date of Patent: *Nov. 27, 2007**

(54) SECURITY SYSTEM AND PERIMETER BEAM TOWER

(75) Inventor: Robert B. Houston, Homestead, FL (US)

(73) Assignee: Solarbeam Security, LLC, Homestead, FL (US)

( * ) Notice: Subject to any disclaimer, the term of this patent is extended or adjusted under 35 U.S.C. 154(b) by 205 days.

This patent is subject to a terminal disclaimer.

(21) Appl. No.: 10/933,595

(22) Filed: Sep. 3, 2004

(65) Prior Publication Data

US 2007/0035394 A1 Feb. 15, 2007

Related U.S. Application Data

(63) Continuation-in-part of application No. 09/956,558, filed on Sep. 20, 2001, now Pat. No. 6,801,128.

(60) Provisional application No. 60/234,227, filed on Sep. 21, 2000.

(51) Int. Cl.
*G08B 13/18* (2006.01)

(52) U.S. Cl. ..... 340/556; 340/557; 340/693.5; 361/600; 248/121; 248/127; 248/346.01; 248/637

(58) Field of Classification Search ..... None
See application file for complete search history.

(56) References Cited

U.S. PATENT DOCUMENTS

| | | | | | |
|---|---|---|---|---|---|
| 4,186,388 | A * | 1/1980 | Robinson | 340/556 |
| 4,978,942 | A * | 12/1990 | Bruce | 340/556 |
| 5,049,858 | A * | 9/1991 | Price | 340/552 |
| 5,198,799 | A * | 3/1993 | Pascale | 340/552 |
| 5,552,767 | A * | 9/1996 | Toman | 340/540 |
| 5,554,972 | A * | 9/1996 | Byrne | 340/556 |
| 5,622,078 | A * | 4/1997 | Mattson | 74/89.23 |
| 6,118,375 | A * | 9/2000 | Duncan | 340/541 |
| 6,774,790 | B1 * | 8/2004 | Houston | 340/556 |
| 6,801,128 | B1 * | 10/2004 | Houston | 340/556 |

* cited by examiner

*Primary Examiner*—Benjamin C. Lee
(74) *Attorney, Agent, or Firm*—Krieg DeVault LLP

(57) ABSTRACT

A solar powered perimeter beam security system comprising a plurality of spaced towers. The towers have detection beams extending between them for detecting an intruder when at least one of the detection beams is interrupted. Each of the towers communicates with a remote unit. At least one of the towers is movable from one location to another. An alarm. The detection beams define an intruder detection area into which an intruder cannot pass without breaking at least one of the detection beams thereby setting off the alarm. The detection area is expandable and decreasable by moving at least one of the towers. The towers are incapable of movement without setting off the alarm once positioned with the detections beams being activated.

30 Claims, 24 Drawing Sheets

POINT TO POINT SINGLE QUAD BEAM
MAXIMUM DISTANCE 660 FEET FROM TOWER TO TOWER

POINT TO POINT SINGLE DUAL BEAM
MAXIMUM DISTANCE 660 FEET FROM TOWER TO TOWER

HIGH/LOW – MAXIMUM DISTANCE 660 FEET FROM TOWER TO TOWER

HIGHEST LEVEL - MAXIMUM DISTANCE OF 450 FEET FROM TOWER TO TOWER

SECURITY SYSTEM AND PERIMETER BEAM TOWER

CROSS-REFERENCE TO RELATED APPLICATIONS

This application is a continuation-in-part of U.S. patent application Ser. No. 09/956,558 filed on Sep. 20, 2001, now U.S. Pat. No. 6,801,128, which claims the benefit of U.S. Provisional Patent Application No. 60/234,227 filed on Sep. 21, 2000. Both the provisional application and the pending application are now incorporated by reference herein.

FIELD OF THE INVENTION

The present invention relates to a solar powered perimeter beam apparatus and the support towers for electronic and solar equipment, and more particularly, the invention relates to (1) a solar powered perimeter beam apparatus for an intruder detection system using a one-half duplex digital/analog transceiver that communicates from remote towers to a central unit having a master control receiver, and (2) a perimeter beam tower apparatus for an intruder detection system.

BACKGROUND OF THE INVENTION

There are known types of solar powered systems, and it is a problem in the art to house solar-powered radio equipment. It is a further problem in the art to house a control system and power for solar-power photo-electric or microwave beam equipment.

U.S. Pat. No. 5,554,972 issued to Byrne teaches an electronic perimeter warning system. The apparatus provides transmitters and receivers powered by solar-powered batteries, and include an alarm system.

U.S. Pat. No. 5,552,767 issued to Toman teaches an assembly for detecting and signaling when an object enters a zone. This system includes a solar powered warning signal actuation device and a plurality of transmitting sensor pairs linked together and stationed around the perimeter of an area to be protected.

U.S. Pat. No. 5,848,707 issued to Hill teaches a storage rack with position sensing. This patent shows a storage system which includes transmitters and receivers located in storage racks, and an alarm for signaling when a beam of radiation has been interrupted.

U.S. Pat. No. 4,191,953 issued to Woode teaches an intrusion sensor and aerial therefore. This patent includes a perimeter surveillance system having transmitters and receivers which use microwave frequencies of radiation.

There are known types of towers. It is a problem in the art to house solar-powered radio equipment, and multiple beam generators for an intruder detection system.

U.S. Design Patent No. Des. 341,221 issued to Elazari teaches a solar powered outdoor lamp. The lamp has a base and a support pole.

U.S. Pat. No. 4,281,369 issued to Batte teaches a method and apparatus for solar powered lighting. It includes plural panels mounted atop a light pole with a support base.

U.S. Pat. No. 4,841,416 issued to Doss teaches a solar charging lamp. It includes a support post mounted atop a base and having a light globe on top, and having solar panels attached to the pole.

U.S. Design Patent No. Des. 353,014 issued to Elazari teaches a solar powered outdoor lamp. The lamp includes a globe mounted atop a pole, which in turn is mounted atop a base, and includes two solar panels mounted to the pole.

SUMMARY OF THE INVENTION

According to the present invention, a device is provided which meets the aforementioned requirements and needs in the prior art. Specifically, the device according to the present invention provides a secure solar powered perimeter beam system for an intruder detection system.

The security system employs solar towers for detecting an intruder. The security system includes a receiver/processor communicating with electronic devices in the solar beam towers, the receiver/processor having an antenna, housing, and an indicator. A detection beam is used to detect intruders. The detection beam may be a photo-electric beam, an infrared beam, a laser beam, a microwave beam or a visible light beam, or a combination thereof.

The security system employs solar towers for detecting an intruder. The security system includes a receiver/processor communicating with electronic devices in the solar beam towers, the receiver/processor having an antenna, a housing and an indicator. The indicator includes information on the location of an intrusion.

A detection beam is used to detect intruders. The alarms sent out by the solar powered perimeter beam apparatus may include devices such as an audible alarm, a visible alarm, a telephone dialer, a printer or a recording device. The central unit exchanges information between the remote units via two way half-duplex radio device. The system is a radio data reporting system, which reports events and selectively transmits an alarm. An alarm is transmitted to the central unit when a new event is detected, and it is displayed there. The system includes a central unit board having indicators, working components including LED's and pushbuttons, and at least one remote unit board.

The solar tower preferably includes a 20 watt solar panel, a stainless steel solar mounting bracket, a swivel clamping bolt, a swivel bracket O-ring, a swivel solar bracket, a solar cap O-ring, a solar cap opening mechanism, a solar base cap, and a stainless steel top plate. The solar tower also includes frame support rods, a frame unit, a six inch frame tower, face shields, a battery clamp, a base unit, and face shield slots.

From the foregoing, it is seen that it is a problem in the art to provide a device meeting the above requirements. According to the present invention, a device is provided which meets the aforementioned requirements and needs in the prior art. Specifically, the device according to the present invention provides a secure and conveniently installable perimeter beam tower for an intruder detection system. The system may be remotely powered, or powered by a solar panel mounted upon the tower.

The security system employs multiple beam generators on the tower to generate multiple beams which extend to an adjacent tower. The security system includes a receiver/processor and transmitter for communicating with electronic devices between the perimeter beam towers and a remote processing central unit. Each tower houses a receiver/processor and transmitting device having an antenna, housing, and an indicator. The indicator includes information on the location of an intrusion.

A solar panel may be mounted to the perimeter bam tower to provide local power, eliminating the need to supply power from a remote source. When a solar panel is used, the solar panel is supported by a mounting bracket, a swivel clamping bolt, a swivel bracket O-ring, a swivel solar bracket, a solar cap O-ring, a solar cap opening mechanism, a solar base cap, and a stainless steel top plate. The perimeter beam tower also includes frame support rods, a frame unit, a frame tower, face shields, a base unit, and face shield slots.

Other objects and advantages of the present invention will be more readily apparent from the following detailed description when read in conjunction with the accompanying drawings.

DETAILED DESCRIPTION OF THE INVENTION

Figure 1:
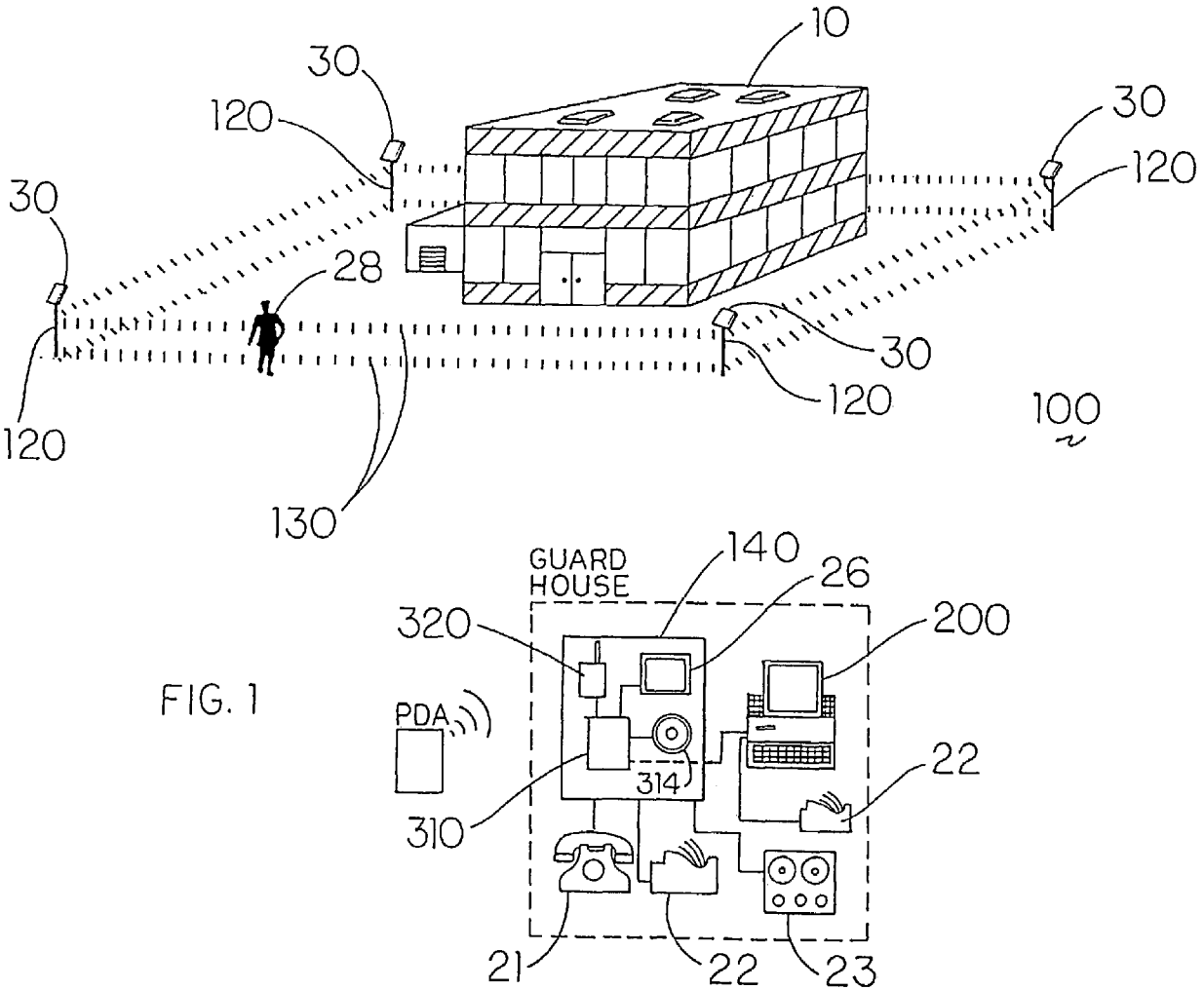
FIG. 1 depicts a security system employing solar towers for emitting a detection beam and a remote central unit, according to the present invention.

FIG. 1 is a perspective view illustrating a security system 100 employing solar towers 120 for detecting an intruder 28. The security system 100 includes a receiver/processor and transmitter unit 20 communicating with electronic devices in the solar beam towers 120, the receiver/processor and transmitter unit 20 having an antenna 22, housing 24, and an indicator 26. In specific versions of the security system 100, the receiver/processor and transmitter unit 20 may be a single unit having an antenna 22, housing 24 and an indicator 26. In other version, the receiver unit and processor unit and transmitter unit are separate unit each operatively connected to an antenna 22 and an indicator 26. The indicator 26 includes information on the location of an intrusion. In the security system 100 of FIG. 1, a photoelectric detection beam is used to detect intruders; however, an infrared beam, a laser beam, a microwave beam or a visible light beam, or any combination of detection beams may be used.

The alarms sent out by the solar powered perimeter beam apparatus 10 comprise at least one of: an audible alarm, a visual alarm, a telephone dialer, a printer and a recording device.

The central (radio) unit of the present invention preferably exchanges information between the remote units via a two way half-duplex radio. The solar powered perimeter beam apparatus 10 according to the present invention is a radio data reporting system, which reports events and transmits an alarm when the detection beam is breached. The detection alarm is transmitted to the central unit when a new event is detected, and it is displayed there.

The security system 100 is a supervised-wireless perimeter security detection system for outdoor applications. The security system 100 provides easy deployment and installation.

The security system 100 includes a plurality of solar towers 120, each having beam devices 132 comprising a detection beam generator 130 for generating the detection beams which extend between adjacent solar towers 120, and a master control receiver 140 which is a radio communication system corresponding to the receiver/processor and transmitter 20 of FIG. 1.

The parts used in the solar towers 120, described below, are preferably constructed of polycarbon plastic. Any other suitable materials, within the ambit of one ordinarily skilled in this art, are also contemplated as being within the scope of the present invention.

Figure 2:
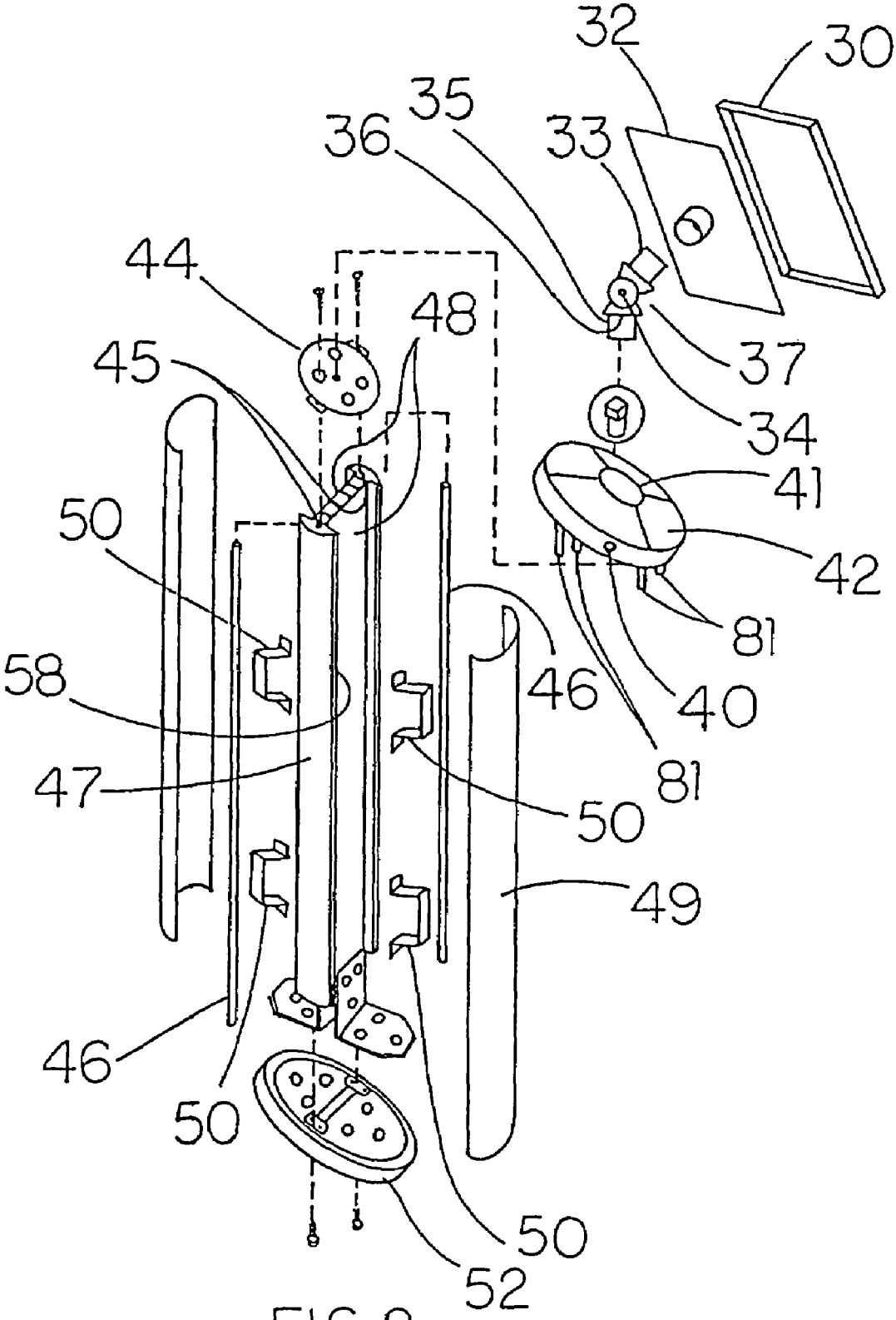
FIG. 2 is an assembly view of a solar tower according to the present invention.

FIG. 2 is an assembly view of one of the solar towers 120. The security system 100 of FIG. 2 includes a 20 watt solar panel 30, a stainless steel solar mounting bracket 32, a swivel clamping bolt 34, a swivel bracket O-ring 36, a swivel solar bracket 37, a solar cap O-ring 38, a solar cap opening mechanism 40, a solar base cap 42, and a stainless steel top plate 44. The security system 100 also includes frame support rods 46, a frame unit 47 (shown in FIGS. 4 and 5), a six inch frame tower 48, face shields 49 (shown in FIG. 9), a battery clamp 50, a base unit 52, and face shield slots 58 (shown in FIG. 6).

The stainless steel solar mounting bracket 32 is mounted to the top of the swivel solar bracket 37, and the power cable from the solar array (not shown) passes through the center of the metal plate into the top of the swivel solar bracket 37. The swivel solar bracket 37 is preferably a two-piece polycarbon swivel bracket that clamps together to allow the solar array panel to be positioned at different angles for viewing the sun. The top piece thereof attaches to the solar mounting bracket 37, and the bottom piece will be inserted inside the swivel solar bracket 37, and the bottom piece will be inserted inside the swivel solar bracket 37 and through the top portion of the solar base cap 42.

The solar base cap 42 and the solar cap opening mechanism 40 (located inside the housing of the cap 42) permits access into the tower 120. A special key may be used, for example, to raise and lower the solar cap 42, using a drill or a screw-type shaft positioned in the center of the solar cap 42. Four alignment pegs 81 allow the solar cap 42 to move freely up and down. A recessed opening in the solar cap 42 allows the swivel solar bracket 37 to be inserted along with a power wire.

Bolts are used to clamp together the top plate 44, the two frame rods 46, and the frame unit 47. The frame unit 47 has a six foot main body which slides over the frame support rods 46 and attaches to the base unit 52. The clamping plate (stainless steel top plate 44) bolts to the support rods 46, giving all three components the strength needed. Open channels inside the solar tower 120 frame allow for the wiring of the equipment (not shown) to be installed inside the solar tower 120 frame.

The base unit 52 is preferably an oval-shaped polycarbonate member which is about eight inches wide, twelve inches long, and two inches high. The base unit 52 is used to secure the main solar tower 120 frame to the ground. In addition, the base unit 52 bolts to the support rods 46 to clamp the solar tower 120 frame unit together. In other versions, the base units 52 of the towers 120 are not secured to the ground. Base units 52, in this version, are provided with means by which the towers may be moved from one position to another as desired to define the desired intruder detection area. The intruder detection area is fully defined by the detection beams extending between the towers.

Figure 29:
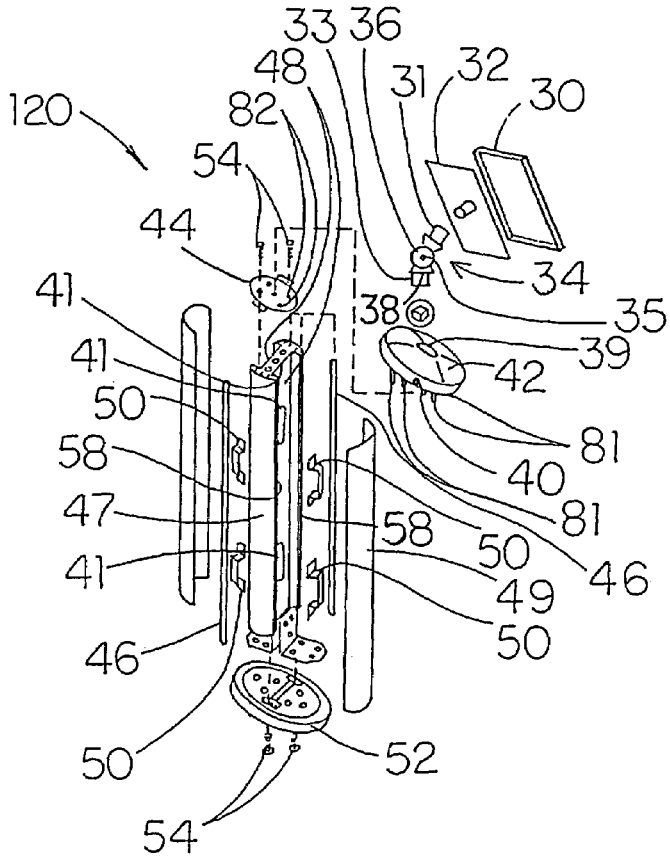
FIG. 29 is a breakaway view of the perimeter beam tower prior to the assembly.

In the simplest form of the invention, the intruder detection area is in the shape of a triangle with a tower at each of the base angles and the apex angle of the triangle. See FIG. 29. In various versions, at least one of the towers is movable as desired. In other versions, two of the towers are movable with one of them being fixed. In another version, all three towers are movable, and in still another version, two of the towers are fixed and one of the towers is movable. In this version, the detection beam generators 130 and detection beam detectors of adjacent towers are precisely aimed at each other such that the perimeter of the triangular secured area is totally defined by the detection beams extending between adjacent towers and the movement of any one tower will cause a change in the angles defined by the detection beams extending between all three towers and one or more of the detection beams will not be appropriately received by a detection beam detector and the alarm will sound as if an intruder had passed through one of the detection beams and interrupted the perimeter defined by the detection beams.

Each of the secured intruder detection areas in this version is a combination of a multi-sided geometrical area defined by straight lines. Each of said areas consists of a plurality of contiguous triangular areas with a tower at each base angle and apex angle. Each of said detection areas thus has a tower at each angle of each triangular portion thereof. Each of said towers has a plurality of receivers, processors, and transmitters.

In each multi-sided geometrical area defined by the detection beams extending between the towers, some of the towers may serve more than one of the plurality of continuous triangular areas so as to be located at the angles of several of the plurality of contiguous triangular areas of the multi-sided geometrical area defined by the detection beams extending between the towers.

Figure 31:
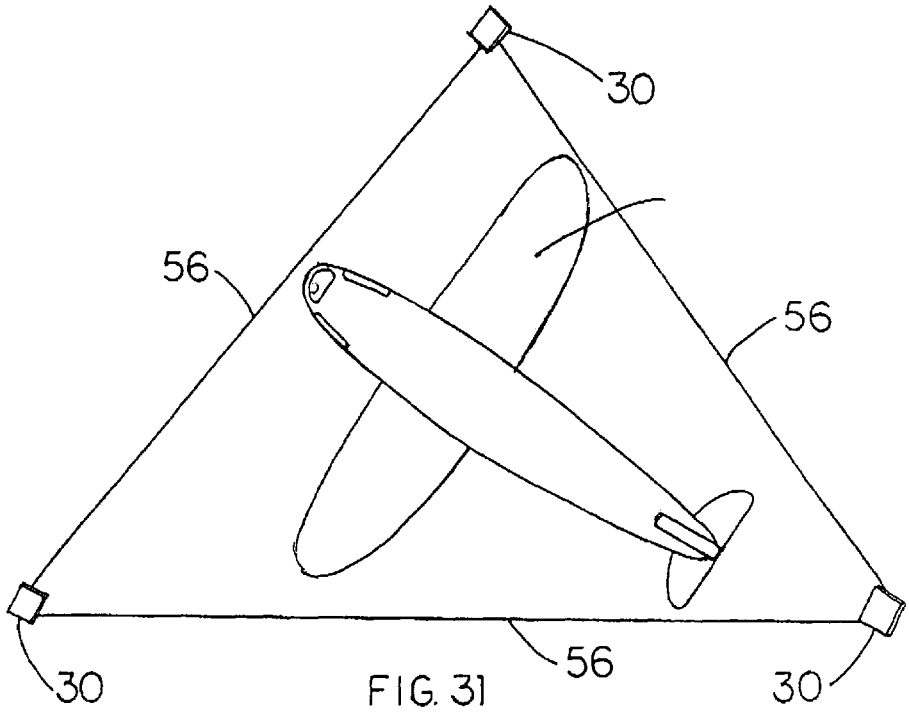
FIG. 31 is a top view of another version of the security system employing solar towers according to the present invention.
Figure 32:
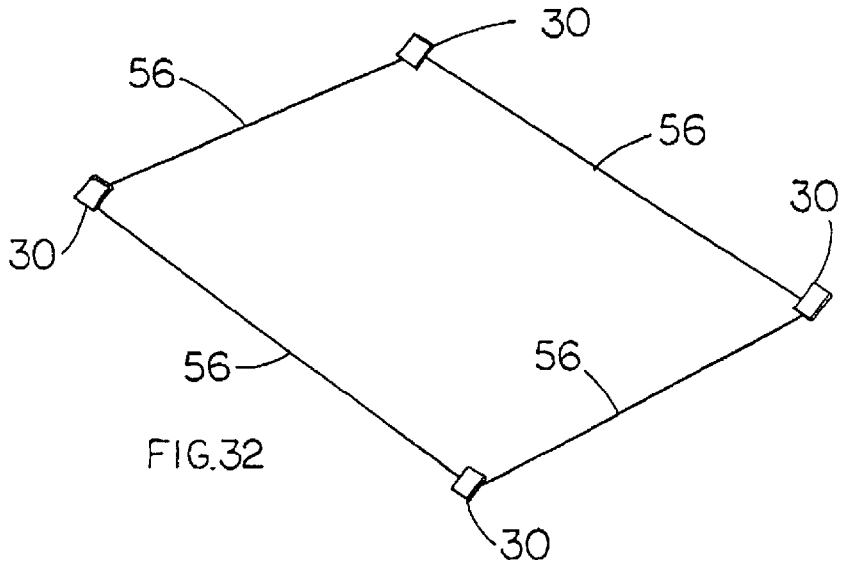
FIG. 32 is a top view of still another version of the security system employing solar towers according to the present invention.
Figure 33:
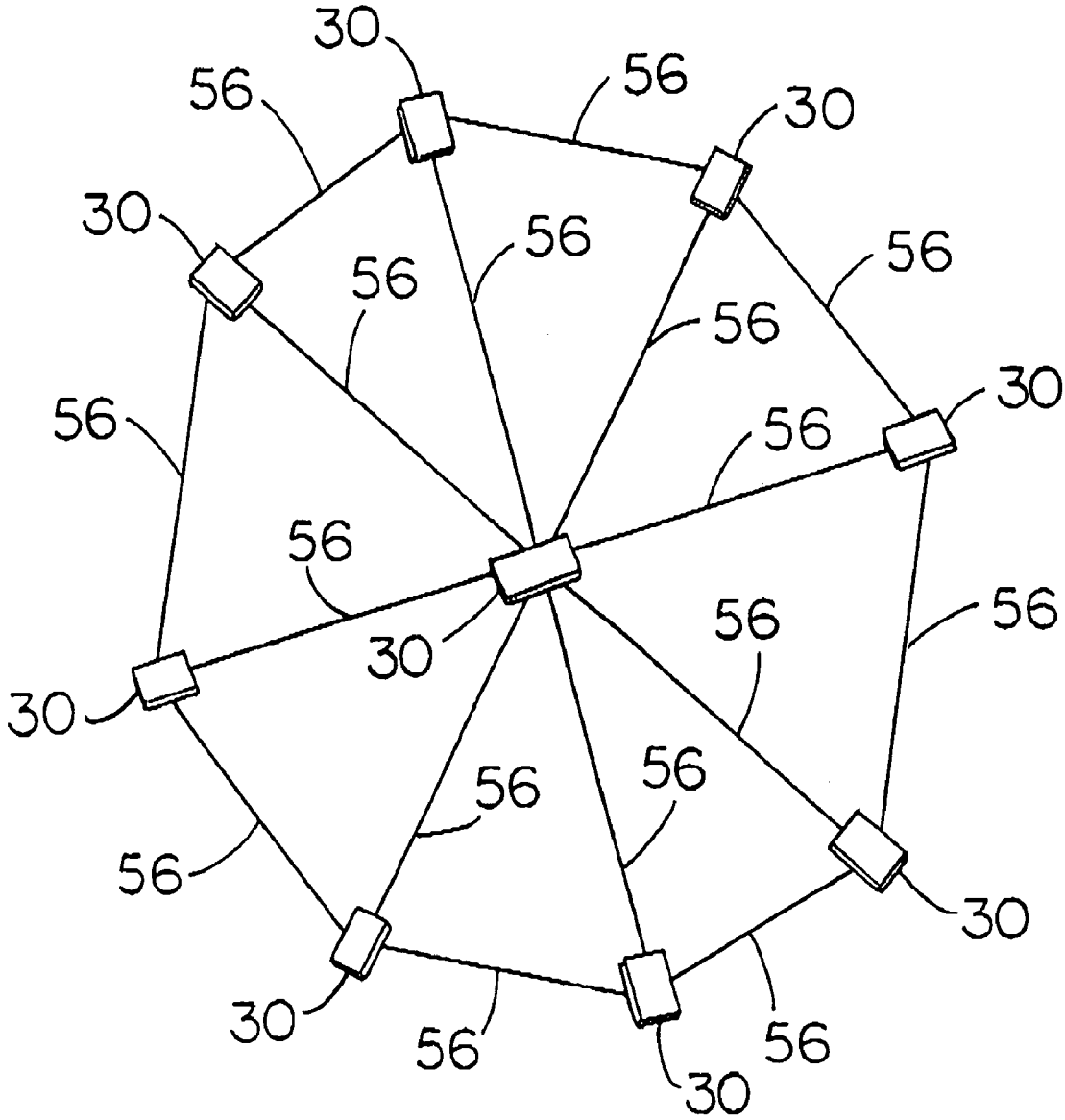
FIG. 33 is a top view of still another version of the security system employing solar towers according to the present invention.

Each of these towers would serve more than one triangular area and be provided with more than two receivers, processors and transmitters. For example, in a pentagonal geometrically shaped intruder detection area, there may be six or more spaced perimeter towers in a circular configuration between which detection beams extend with a central tower equally spaced from all of the perimeter towers which receive and send the detection beam back to each of the perimeter towers. Thus, the central tower serves all of the different triangular detection areas that make up the pentagonal intruder detection area. The central tower would have multiple detection beam generators and multiple detection beam detectors whereas each of the perimeter towers would have either one detector and two generators or two detectors and one generator as the case may be. See FIG. 31.

Figure 30:
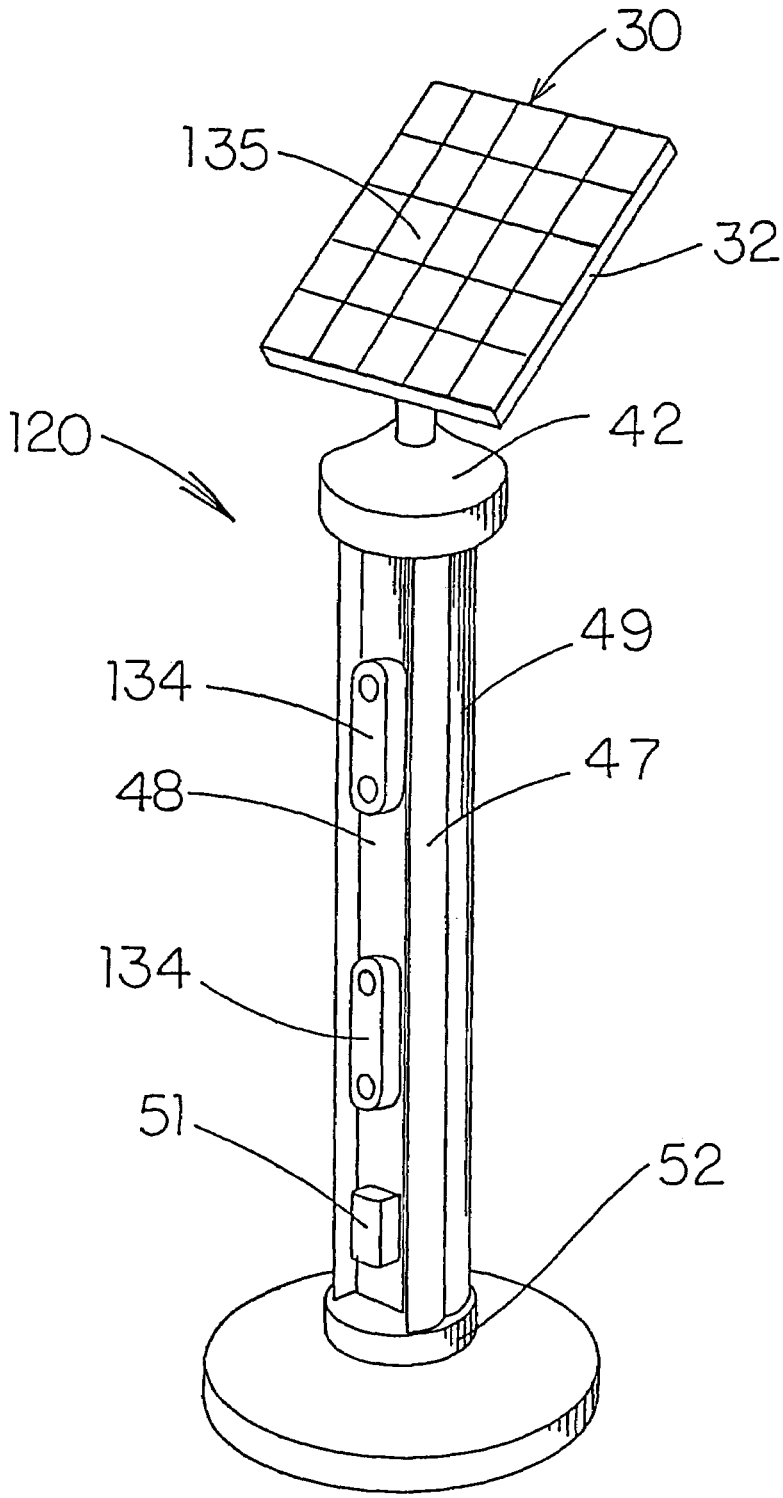
FIG. 30 is a photograph of the perimeter beam tower with one of the face shields removed.

In still other versions, the intruder detection area may define a geometrical area that is a parallelogram. Each of the parallelogram areas may be defined by two contiguous triangles or four contiguous triangles depending upon whether or not a detection beam is extended between one pair of opposite towers or both pair of opposite towers. Parallelogram areas may be defined by multiple contiguous triangular areas as illustrated in FIG. 30.

In each of said towers, the detection beam generators and the detection beam detectors can be aimed separately so as to send and receive the detection beam as desired. Each detection beam has a central axis which is positioned in the center of each generator and each detector and a cross-sectional area which is superimposed on the detector areas before the detection beam generators and detectors are fixed in each tower. Once fixed, any attempt to move the tower or to change the directional setting between the detection beam generators and detection beam detectors will set off the alarm.

The security system 100 also includes the face shields 49 (shown in FIG. 9), which are also preferably made of polycarbon plastic, and are U-shaped (i.e., shaped in a half-oval pattern). Each piece is about 5½ inches wide and six feet high. The face shields 49 are inserted into the base unit 52 first. Then, the face shields 49 are inserted into channels in the frame unit 47. The frame support rods 46 are preferably aluminum poles six feet high and ¾ inches in diameter. At each end of the rods 46 are welded-on nuts that bolt the base plate (base unit 52), the frame unit 47, and the clamping plate 44.

Figure 3:
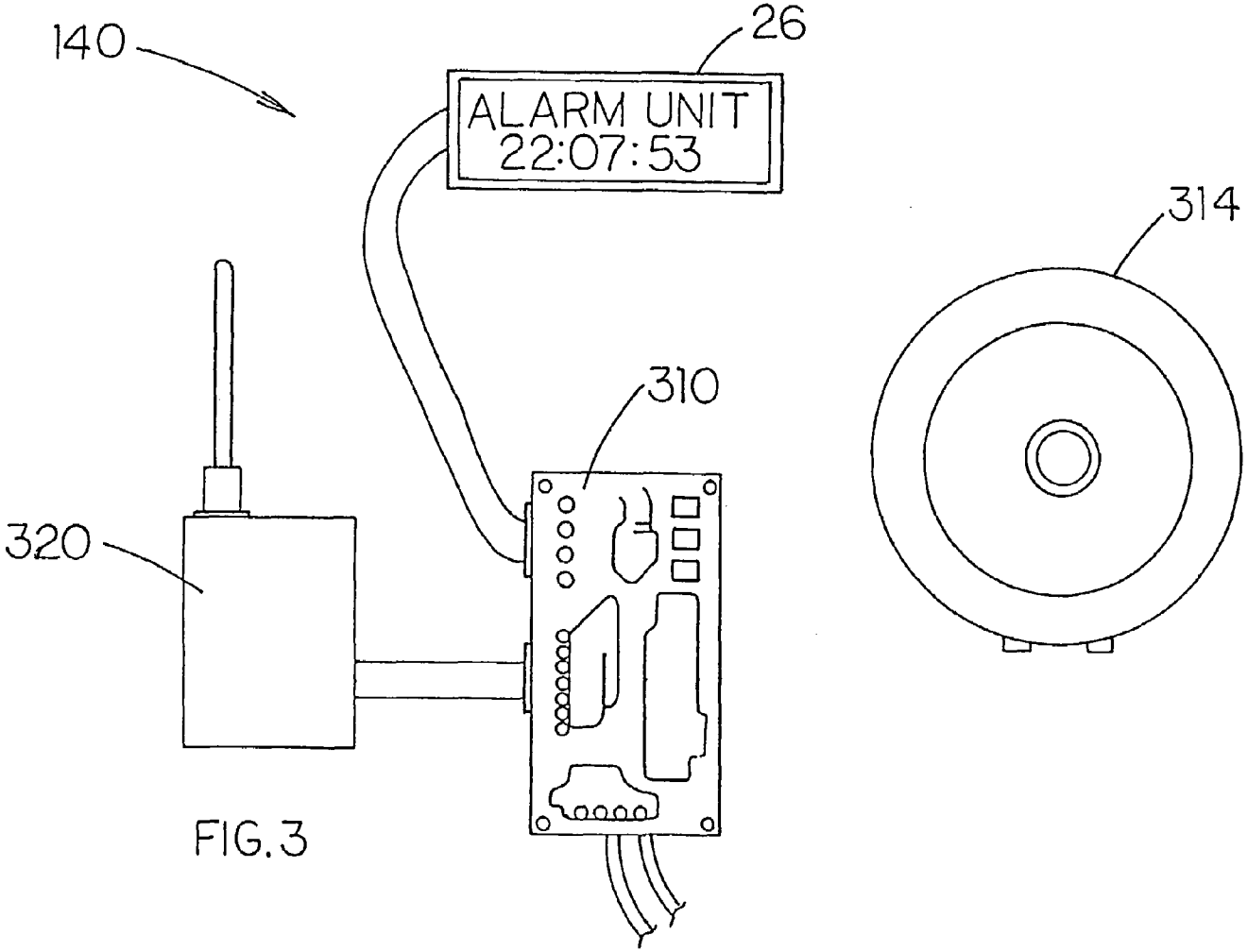
FIG. 3 is a front view illustrating a central unit circuit board, a radio transmission/reception device, a display and a speaker for a security system according to the present invention.

FIG. 3 is a front elevational view of a security system 300 according to the invention, having a central unit circuit board 310, a radio transmission/reception device 320, a display 312, and a speaker 314 used to sound an alarm. The radio transmission/reception device 320 is preferably an FM RTX radio. The security system as a whole includes at least two half-duplex two-way radios. This type of half-duplex system substantially prevents sabotage and detects intentional radio jamming. The central unit circuit board 310 includes a CPU which communicates with the display 312 to indicate time, actions, and status of remotes (digital alarms and analog signals, battery voltage and board temperature). This central unit circuit board 310 has sufficient memory to provide capability of storing events and printing them on an external standard printer (not shown).

One having ordinary skill in the two-way radio transmission art would understand how to embody the elements and connections necessary to carry out the above-described functions.

Figure 4:
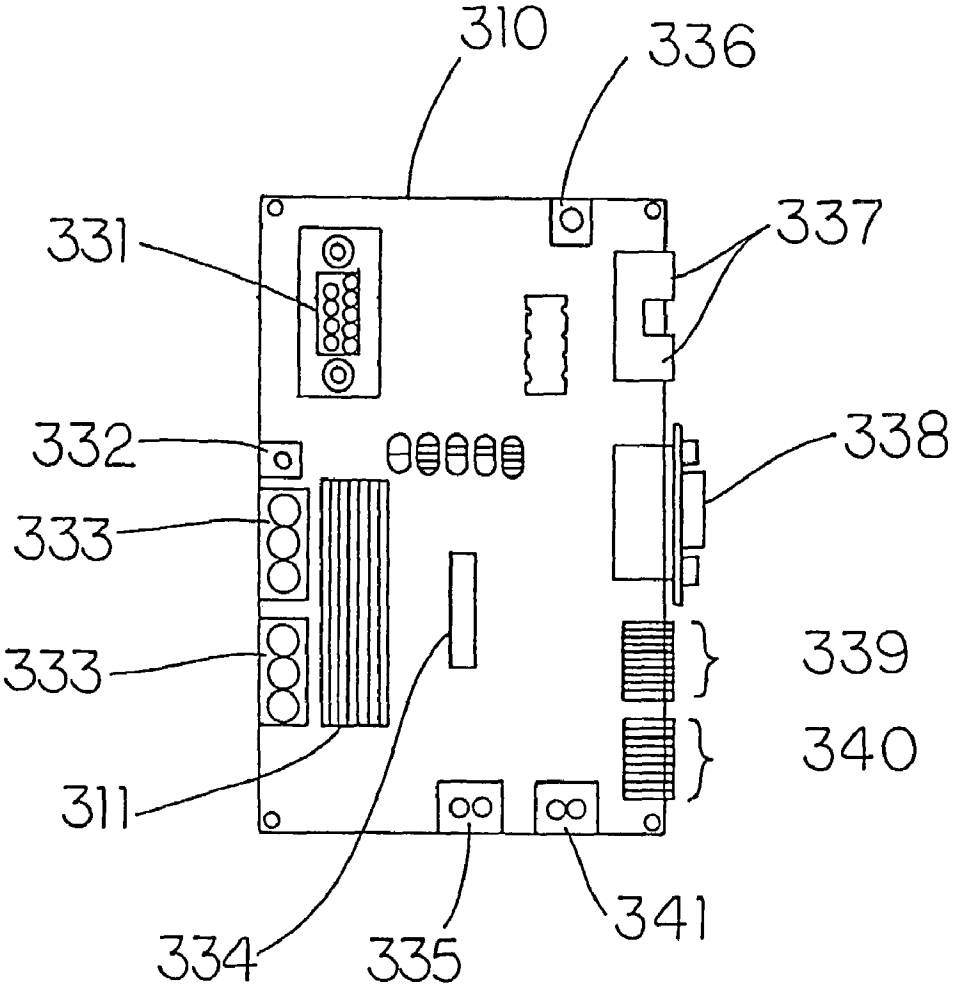
FIG. 4 is a front view of the central unit circuit board illustrating connections for various working components to be connected to the back side of the central unit circuit board of FIG. 3.

FIG. 4 is a perspective view of working components mounted on the circuit board 310 of FIG. 3. The central unit circuit board 310 of FIG. 4 includes a programming socket 331, a speaker output connection 332, and an alarm relay output connection 333.

The central unit circuit board 310 also includes a clock battery 334, a 12 volt DC battery 335, a display contrast control 336, and a display/printer output port 337. The central unit circuit board 310 further includes a connector for an FM radio 338, a connector for a CPM-016-FM radio 339, a connector for a CPM-016-AM radio 340 (which is a connection for a standard ON-OFF-keying half-duplex radio), and a supply/charger connection 341 which is preferably made for connection to a source of voltage in the range of 14.5 volts DC to 18 volts DC and which is switchable to put the unit ON-OFF.

In FIG. 4, the programming socket 331 is used to program the central unit circuit board 310 by an external PC.

Figure 5:
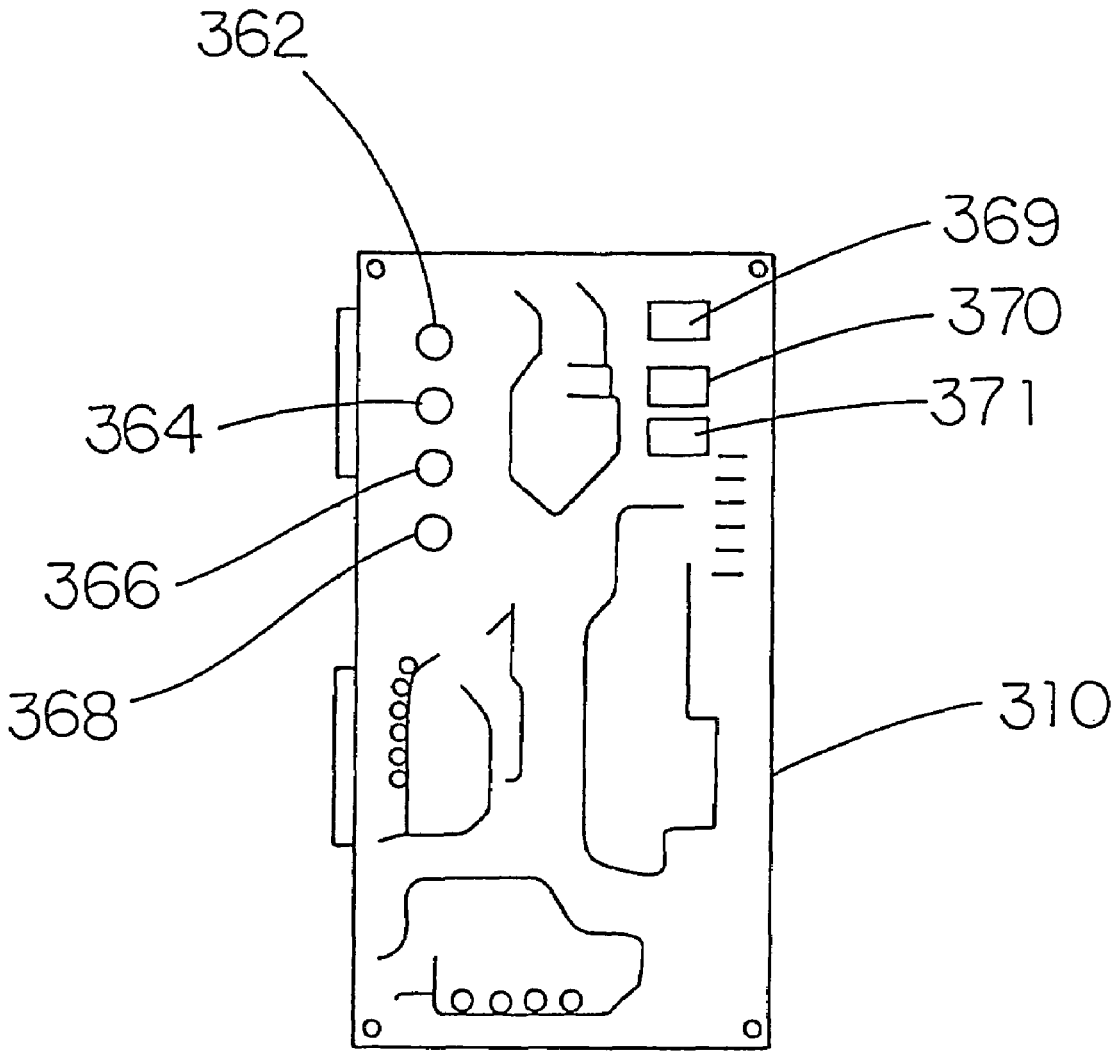
FIG. 5 illustrates various LED's and pushbutton control features on the front side of the central unit circuit board.

FIG. 5 illustrates the central unit LED's and pushbuttons on the central unit circuit board 310. Specifically, FIG. 5 shows that the central unit circuit board 310 includes an "ON" LED 362 which is lit when the battery and/or power supply is present on board, a "CLOCK" LED 364 (flashing at one pulse per second, indicating that the CPU is working), and an alarm memory LED 366 which is "ON" when an alarm has been detected and not yet reset.

The central unit circuit board 310 of FIG. 5 also shows a fault memory LED 368 which is "ON" when a telemetry fault has been detected and is not yet reset, and a reset button 369 which can be pushed to test the whole system after an alarm or fault detection, in which a polling cycle will be executed to all remotes. The central unit circuit board 310 includes a clock/up button 370 and a set clock button 371.

The buttons 370 and 371 are preferably used in combination to set a time, or change a time. Such operations, in many variations, are well known and are therefore not described further herein. It would be within the ambit of one having skill in the digital clock setting and control arts to configure, design, and/or make such a clock setting arrangement.

Figure 6:
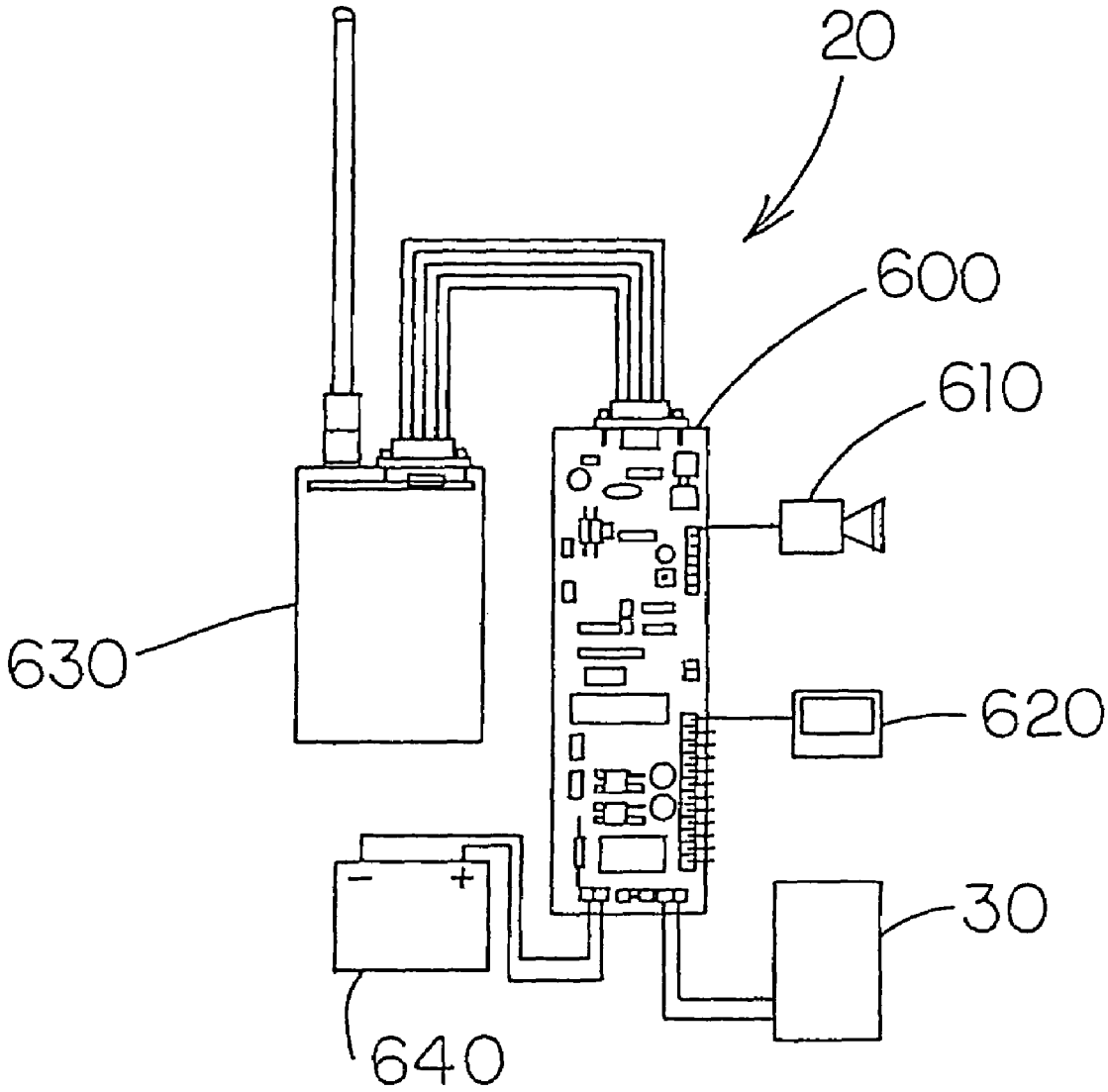
FIG. 6 illustrates an embodiment of the receiver/processor and transmitter unit having a radio transceiver unit, a remote controlled camera and detector.

FIG. 6 illustrates a remote unit board 600 and associated devices. Specifically, FIG. 6 shows an Rtx radio 630, a remote controlled camera 610, and a radiation detector 620. The remote unit board 600 is preferably a CPU equipped PC board having 12 volt DC operation, a solar panel/charger circuit, three different radio interfaces, a temperature sensor, a battery voltage sensor, four analog input channels (two of which are for temperature and battery voltage), a settable threshold for the four channel analog IN to generate an alarm, an eight digital alarm in—optical decoupled—normally low, a bi-directional polling and/or simple one-way only transmission (using dip switch settings), dip switch time settable telemetry transmission in the "only TX" equipped systems, a local check up capability to test the radio reception, and remote unit identification by dip switch settings.

Figure 7:
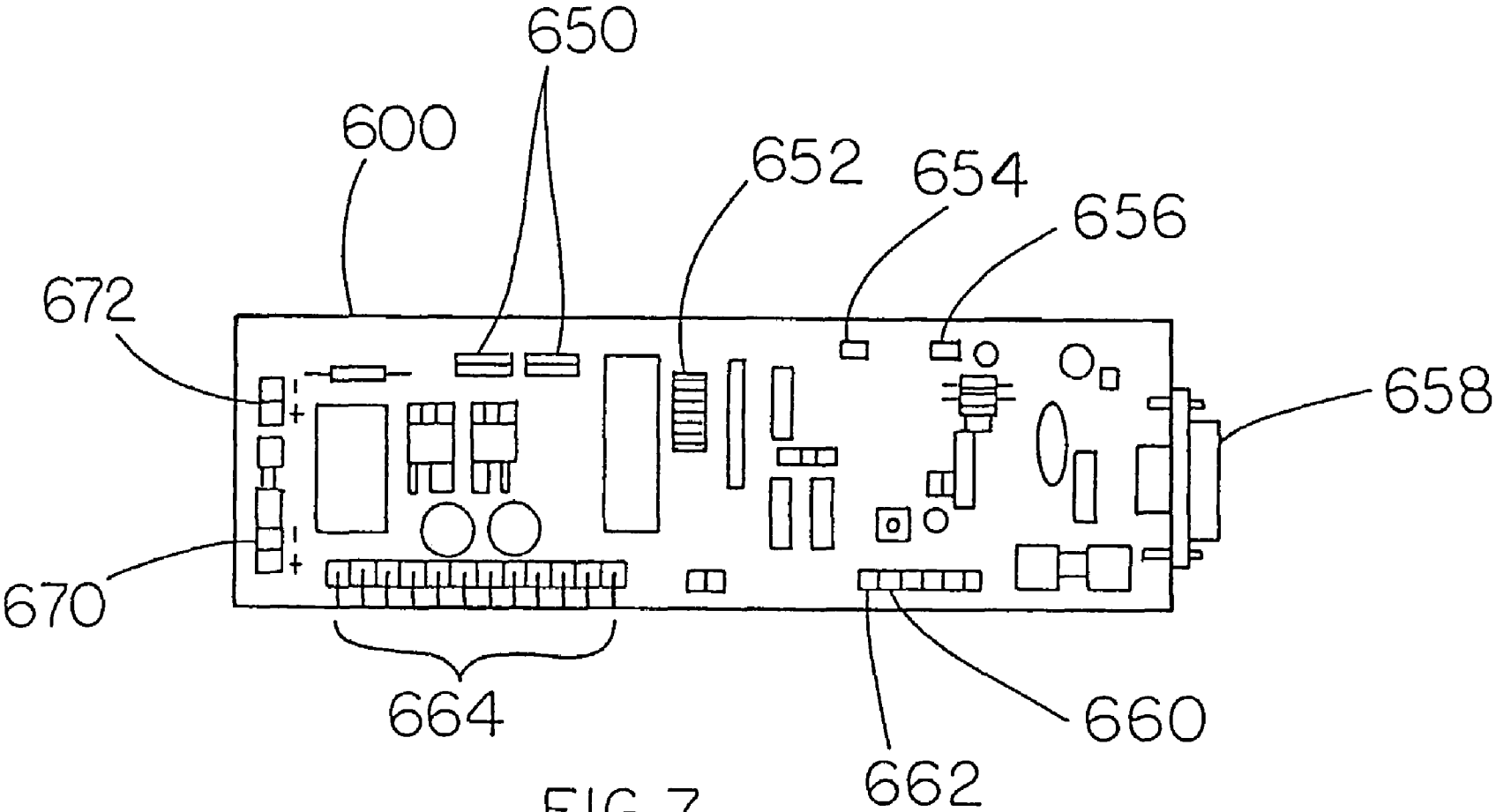
FIG. 7 is a front view of the remote unit board illustrating connections for various working components to be connected to the remote unit board of FIG. 6.

FIG. 7 illustrates a connection of the remote unit board 600 of FIG. 6. In this view, the remote unit board 600 includes a relay out 650 for contacts out for a remote command from the central unit 310 (to switch ON-OFF a radio, camera, flashlight, etc.), a connection for an ID number 652, a connection for a CPM-AM radio 654, a connection for a CPM-FM radio 656, a connection for an FCC FM radio 658, a reset button/switch 660, and a connection 662 for receiving/transmitting a setting and a transmission time. The remote unit board 600 also includes a digital and analog "in" connection 664, a charger/solar panel power "in" connection 670, and a 12 volt DC battery "in" connection 672.

At the connection 664, it is possible to connect with eight digital alarm inputs and two analog inputs (0.25 volt DC ground ref., 01. volt DC res.). To generate an alarm, the digital input must be between 5 and 18 volts DC, at 10 mA.

Figure 8:
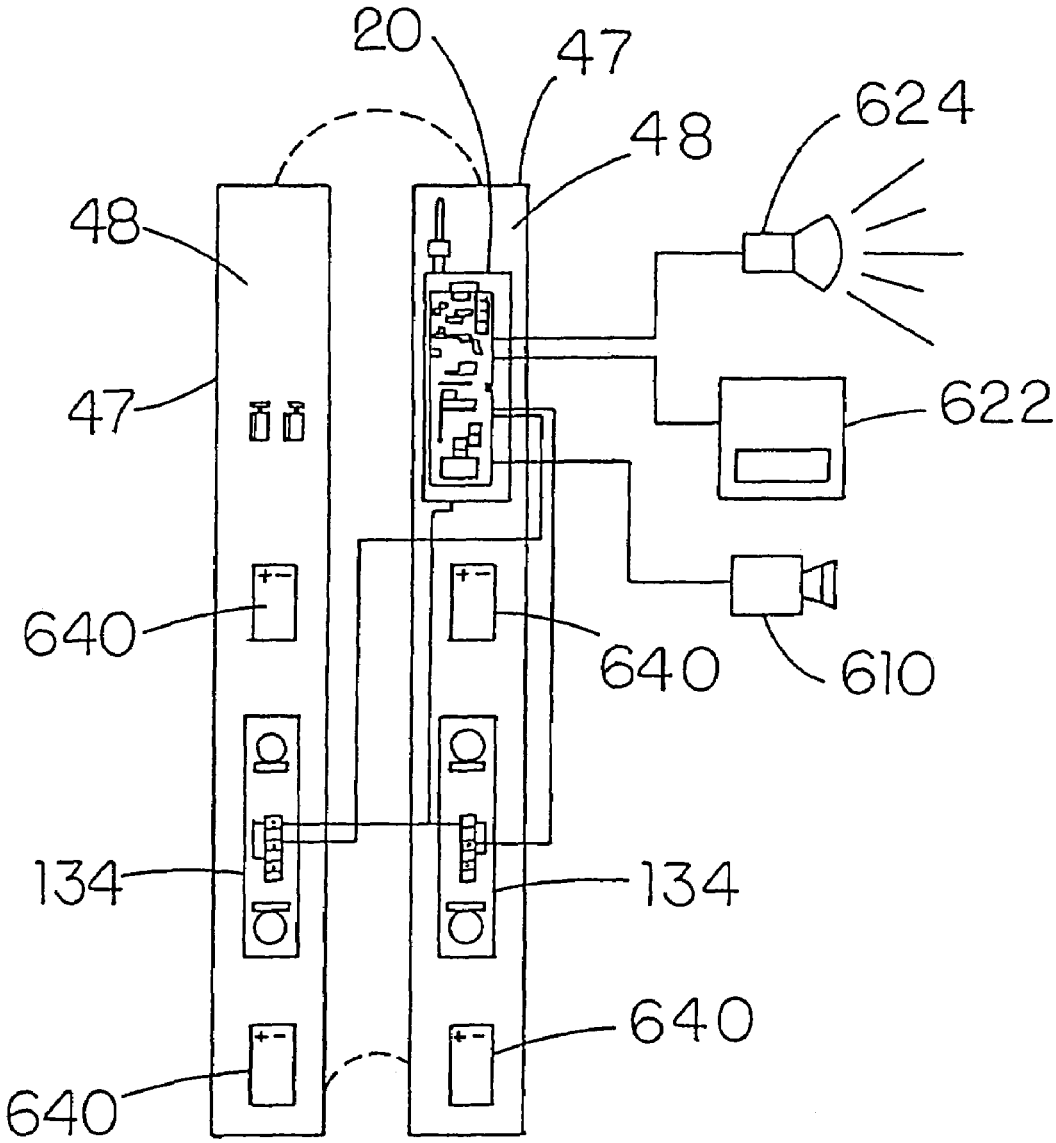
FIG. 8 is a split view of two faces on a solar tower beam unit as shown in FIG. 2, and carrying the electronic elements thereon.

FIG. 8 is an elevational view of a complete solar tower beam unit as in FIG. 2, and carrying the electronic elements thereon of FIGS. 3-7.

The solar power security system 100 is a supervised, wireless perimeter security detection system for outdoor application, featuring easy deployment and installation. Individual solar towers 120 are custom designed to cover the area to be protected, including the features and options selected. Upon receipt, the solar towers 120 are bolted to their respective concrete base unit 52, the beam devices 130 are aligned, and the master control receiver 140 is plugged into a suitable electrical outlet.

The master control receiver 140 and display panel are installed in a guardhouse or central monitoring location. A perimeter light and voice annunciation system will disclose the exact zone and location of any alarm signal received. Red and yellow LED lights located around the display panel will show all activity from the solar beam towers 120. The red light indicates an alarm condition and the yellow light represents the zone(s) bypassed. An RS 232 connection port is provided for remote video camera signals.

The master control receiver 140 will have the ability to send and receive information by duplex transmission, and provide a complete status of the perimeter security system 100. Bypass buttons and other sounding devices will be installed in the system's display panel 312. All ancillary functions, such as low battery, signal loss, and alarm signals from any tower 120 will also be visible on the display panel 312.

In addition to the zone display panel 312, the receiver 20 can interface with a standard PC computer and software. The receiver 20 works much like the remote transmitters 320 located in the solar towers 120. The receiver 20 uses a standard FCC approved transmitter 320, which is connected to an encoder printed circuit board 310. The encoder board receives dialog from the beam tower 120 transmitter and gives the necessary information output to the display panel and/or computer.

The transmitter 320 is preferably a 3 to 5 mile, 5 watt radio transmitter. A decoder is preferably attached to the transmitter via RS 232 cable. The decoder receives dialog from the beam detection unit, which is preferably a Pulnix BPIN200HF, and transmits this information to the receiver. Both transmitter and receiver communicate in duplex mode between the tower(s) and the master control. This allows the control panel to send a signal to the transmitter to verify its status, or to activate the remote camera, check voltage on batteries, or turn on a microphone/speaker module to hear and talk, if needed.

The remote control camera 610 plugs into the existing transmitter, and when actuated, will photograph the activity or violation, and transmit the digital image via the radio transmitter 320. The control receiver 140 located at the guardhouse will receive several photos for printing and documentation. Both still photographs and video transmission are to be considered within the scope of this disclosure.

When a person or vehicle interrupts a beam path 130 at one of the remote towers 120, a telemetry radio signal is transmitted to the command or master control receiver 140, designating the exact zone or location of the alarm. The command receiver 140 is designed to notify security personnel via voice and zone display, beeper, hand-held radio or to a 24 hour central station.

The photoelectric beam 130 is preferably a point-to-point multi-level quad beam, having a range of up to 600 feet to 800 feet from tower 120 to tower 120. All four beam 130 paths must be broken simultaneously to activate an alarm. This eliminates false alarms when birds, dogs or other animals pass through the photoelectric beam.

Alternately, a microwave unit may be used in a more controlled area, such as prisons or high security level applications. The microwave unit offers total perimeter coverage, but at a range of from 15 feet to 150 feet from tower to tower.

The radio communication 320 system can be of several types of systems, depending on the application or range needed. One such system is a short range radio with a range of approximately 1,500 feet from tower to receiver. Another system is a long range transmitter, having a range of up to 5 miles.

Figure 9:
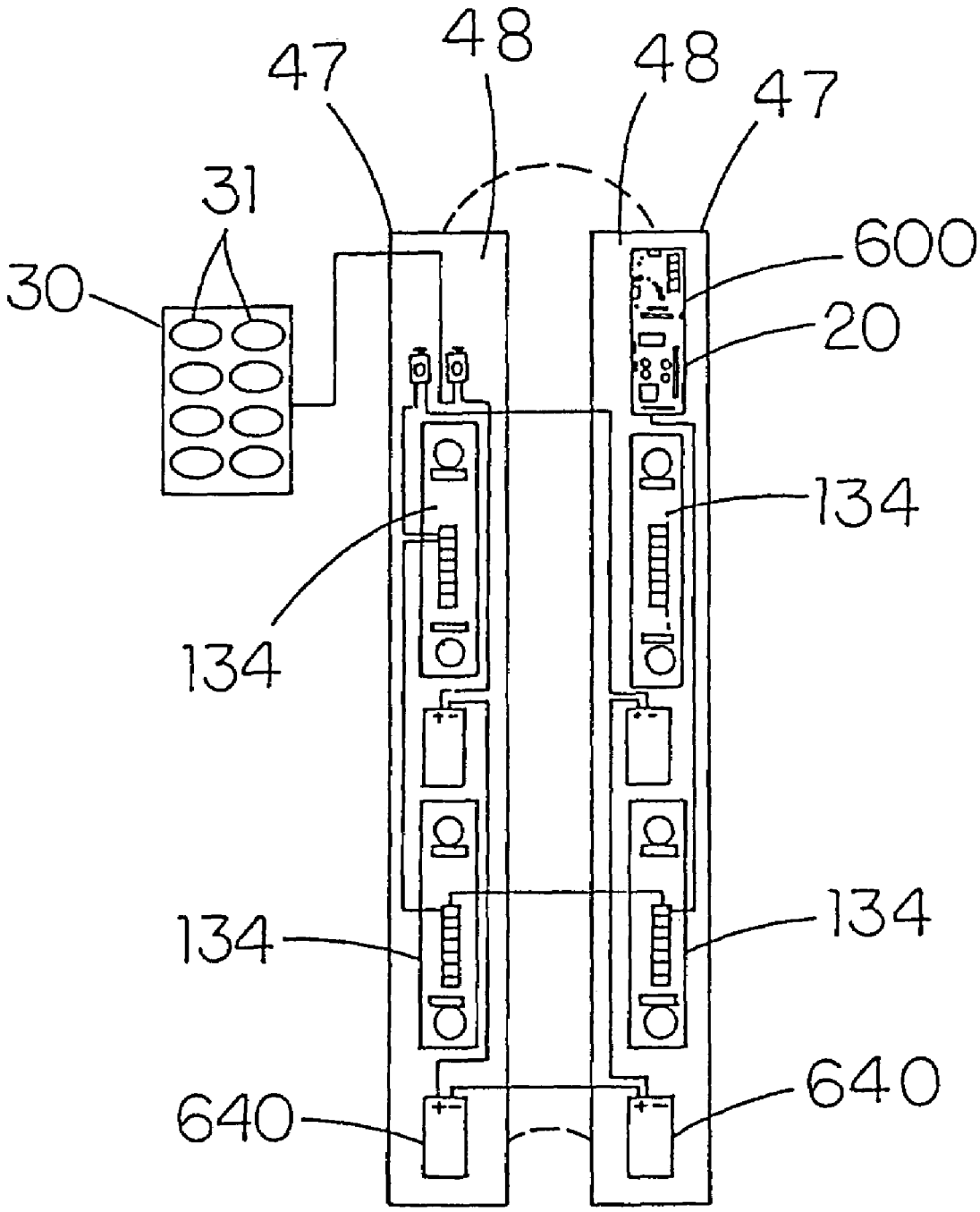
FIG. 9 is a split view of the solar tower beam unit of FIG. 8 showing the electrical power supply connections therein.

FIG. 9 is a perspective view illustrating a security system 100 employing a plurality of perimeter beam towers 120, for detecting an intruder 28. The security system 100 includes a receiver/processor and transmitter 20 communicating with electronic devices in a remote central unit. The receiver/processor and transmitter 20 each have an antenna 22, housing 24, and an indicator 26. The indicator 26 includes information on the location of an intrusion. In the security system 100 of FIG. 9, multiple detection beams are used to detect intruders 28. The multiple detection beams may include an infrared beam, a laser beam, a microwave beam, a visible light beam, or any combination of detection beams.

The security system 100 is a supervised-wireless perimeter security detection system for outdoor applications. The security system 100 provides easy deployment and installation. The perimeter beam towers 120 may be solar powered, or remotely powered where a suitable source of electrical power is available.

The security system 100 includes a plurality of perimeter beam towers 120, and at least one detection beam generator for generating multiple detection beams 56. The detection beams 56 extend between adjacent towers 120 and a breach in the detection beams 56 signals an alarm. A remote control master receiver is preferably used to communicate between perimeter beam towers 120. The remote control master receiver is preferably a radio communication system corresponding to the receiver/processor 20 of FIG. 9.

The perimeter beam tower 120 housing 24, described below, is preferably constructed of a polycarbon composite fiber material. However, other suitable plastic or fiberglass materials are also contemplated as being within the scope of the present invention.

Figure 10:
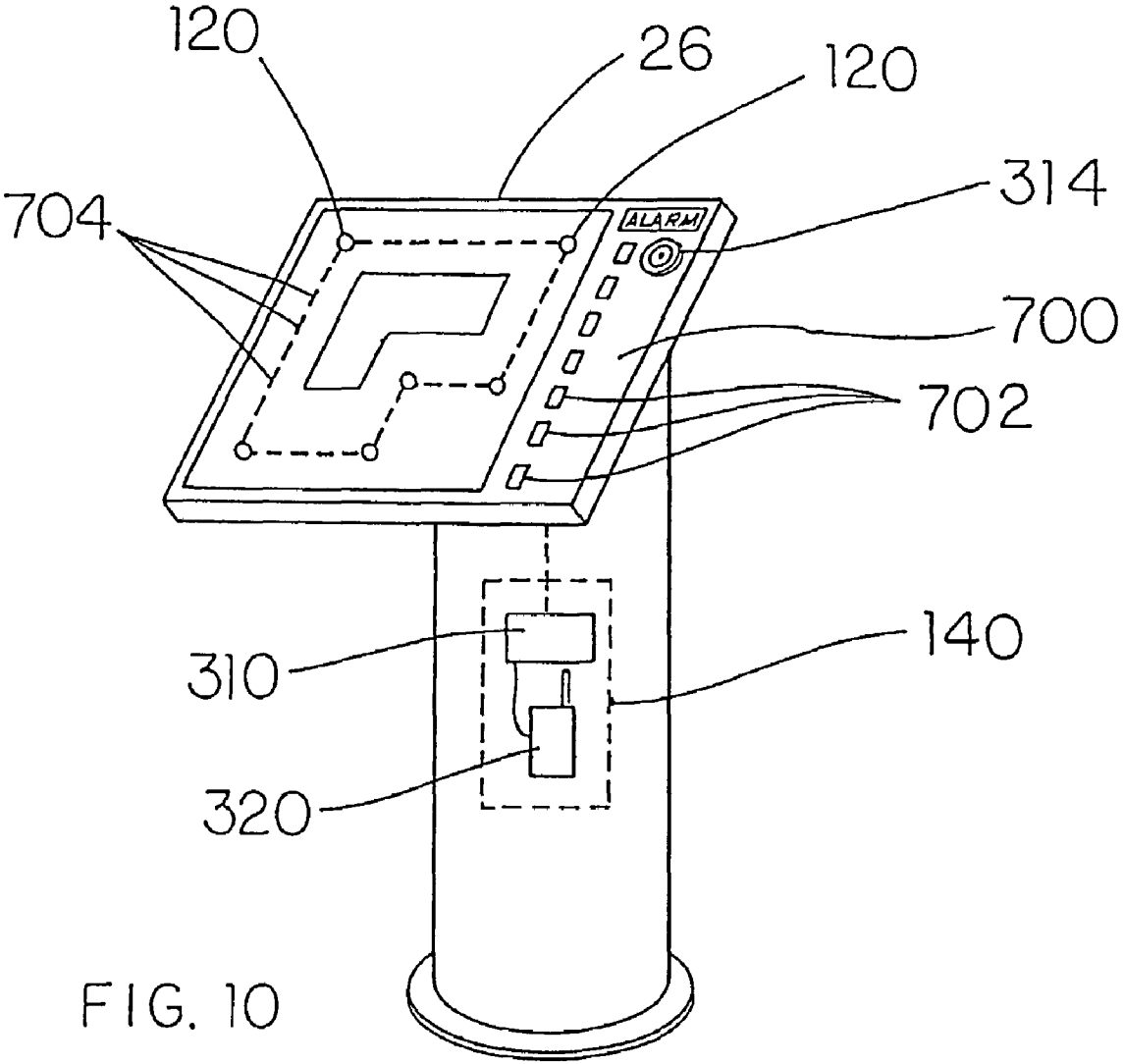
FIG. 10 is a perspective view of an embodiment of a display panel for a central unit.

FIG. 10 is an exploded assembly view of perimeter beam tower 120 powered by a solar panel 30. The security system 100 of FIG. 10 includes a solar panel 30, which is preferably a 20 watt solar panel 30. A solar mounting bracket 32, which is preferably made of stainless steel, or other corrosion resistant materials, is used to secure the solar panel 30 to the upper portion 31 of a swivel clamp 34. The upper portion 31 of the swivel clamp 34 is adjustably secured to a lower portion 33 of the swivel clamp 34. The upper portion 31 and lower portion 33 of the swivel clamp 34 are adjustably secured together with a suitable fastening means, such as a bolt 35. A swivel O-ring 36 is positioned between the upper portion 31 and the lower portion 33 of the swivel clamp 34. The swivel clamp 34 allows the solar panel 30 to be positioned at different angles to better align the solar panel with the sun.

The perimeter beam tower may alternately be powered from a remote power supply source, such as 12 volt, 120 volt, or 240 volt electrical power.

The lower portion 33 of the swivel clamp 34 extends through a solar cap O-ring 38 into a swivel aperture 39 in the solar base cap 42. The solar base cap 42 is mounted upon a top plate 44. The solar base cap 42 has at least two alignment pins 81, and preferably four alignment pins 81, which are received in pin apertures 82 located in the top plate 44. The alignment pins 81 allow the solar cap 42 to move freely up and down.

A solar cap 42 opening mechanism 40 provides access into the housing 24. A power cable 60 extends from the solar panel 30 through the swivel clamp 34 and solar base cap 42, into the housing 24.

At least two support rods 46 are secured to the base unit 52, and extend up to the top plate 44. The support rods 46 are from 5 feet high to 12 feet high, and are preferably from 6 feet to 8 feet high. The support rods 46 are preferably aluminum rods. The frame unit 47 slides over the support rods 46, where the frame unit 47 is secured to the base unit 52. The frame unit 47 is preferably of a height similar to the height of the support rods 46. Open channels 41 inside the frame unit 47 allow for the power cable 60 wiring from the equipment mounted on the solar tower 120 to extend through the open channels 41 in the frame unit 47 to the base unit 52.

Opposing face shields 49 are preferably shaped in a half oval configuration, similar to a U-shaped design. The face shields 49 are preferably made of a polycarbon plastic material. The face shields 49 are preferably of a height similar to the height of the support rods 46.

The face shields 49 are inserted into the face shield slots 58 located on the frame unit 47. A suitable fastening means 54 secures the top plate 44 and the frame unit 47 to the support rods 46.

The base unit 52 is preferably an oval shaped polycarbon molded unit, which is secured to the ground, or to a suitable foundation, such as a concrete footing (not shown) or is provided with means allowing movement of said towers when used to define a triangular intruder detections area as above described. The means can be at least three supports chosen from the group of supports including wheels, feet, rollers, skids and combinations thereof.

A stainless steel solar mounting bracket 32 is mounted to the top of the swivel solar bracket 37. A solar array panel is mounted upon the solar mounting bracket 32. A power cable 62 from the solar array panel 30 passes through the center of the solar mounting bracket 32 into the top of the swivel solar bracket 37.

The swivel solar bracket 37 is preferably a two-piece polycarbon swivel bracket 37 that clamps together to allow the solar array panel 30 to be positioned at different angles for optimal alignment with the sun. The upper portion 31 of the swivel clamp 34 attaches to the solar mounting bracket 37, and the lower portion 33 of the swivel clamp 34 is inserted inside the swivel aperture 39 in the top portion of the solar base cap 42.

The solar base cap 42 and the solar cap opening mechanism 40 (located inside the housing of the cap 42) permits access into the tower 120. A special key 45 may be used, for example, to raise and lower the solar cap 42, using a drill or a screw-type shaft positioned in the center of the cap unit. Four alignment pegs 81 allow the solar cap 42 to move freely up and down. A recessed opening in the solar cap 42 allows the swivel solar bracket 37 to be inserted along with a power wire. A suitable top plate fastening means 51 is used to clamp together the clamping plate 44, the support rods 46, and the frame unit 47.

The frame unit 47 has a main body which slides over the frame support rods 46 and attaches to the base unit 52 with a base unit fastening means 51. The clamping plate bolts to the support rods 46, giving all three components the strength needed. Open channels 41 inside the frame unit 47 allow for the power cable 60 wiring to be installed. An optional battery clamp 50 may be secured to the frame unit 47 to support one or more batteries 53 within the frame unit 47.

The base unit 52 is preferably an oval-shaped polycarbon member which is about 8 inches wide, 12 inches long, and 2 inches high. The base unit 52 is secured with base unit fastening means 54 to the support rods 46 to clamp the frame unit 47 together.

Each face shield 49 is from 4 to 8 inches wide and substantially the height of the frame support rods 46. The face shields 49 are inserted into the base unit 52 first. Then, the face shields 49 are inserted into channels provided in the frame unit 47.

Figure 11:
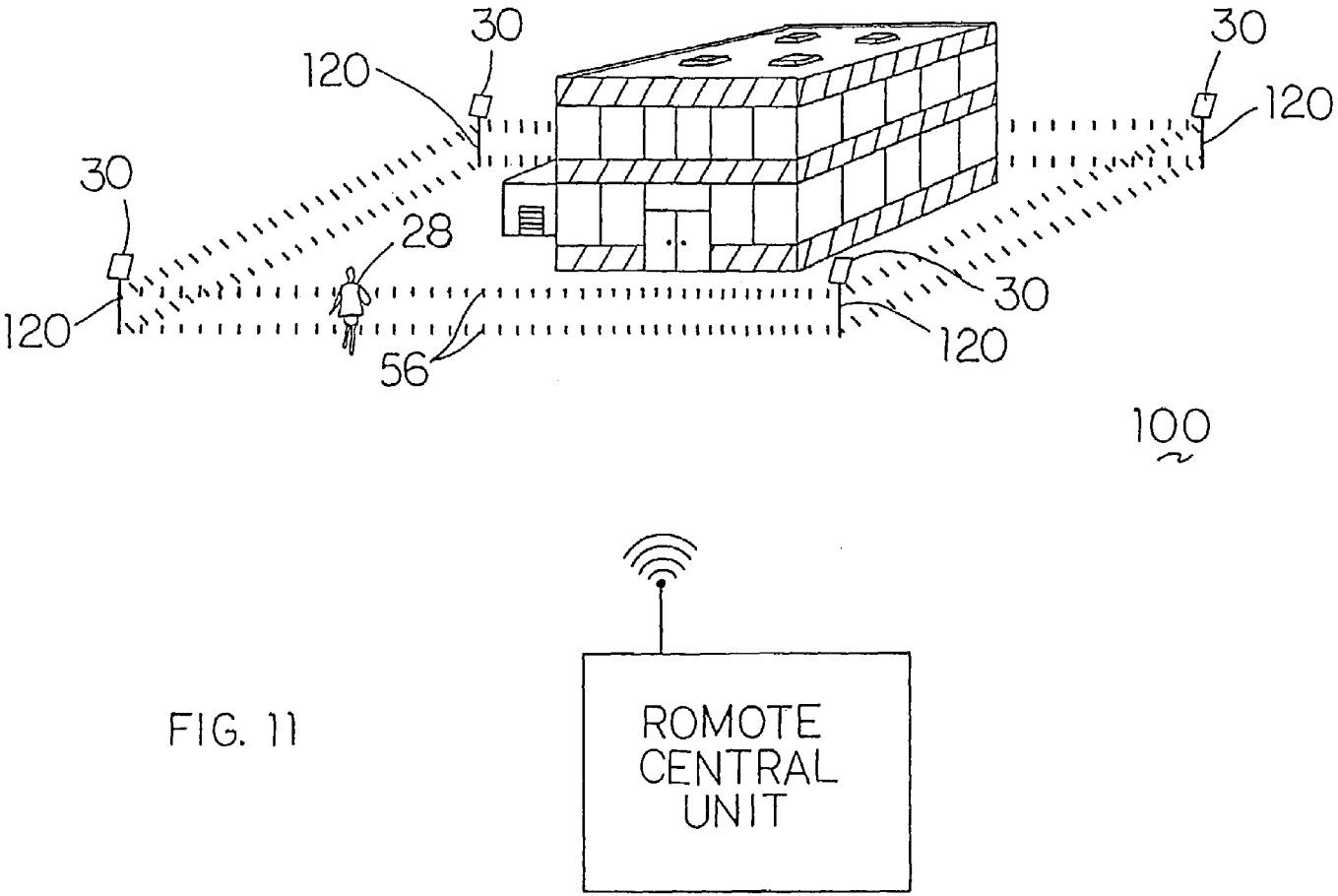
FIG. 11 is a perspective view illustrating a security system employing a plurality of perimeter beam towers according to the present invention.

FIG. 11 is an elevational view of the frame support rods 46 secured into the base unit 52.

Figure 12:
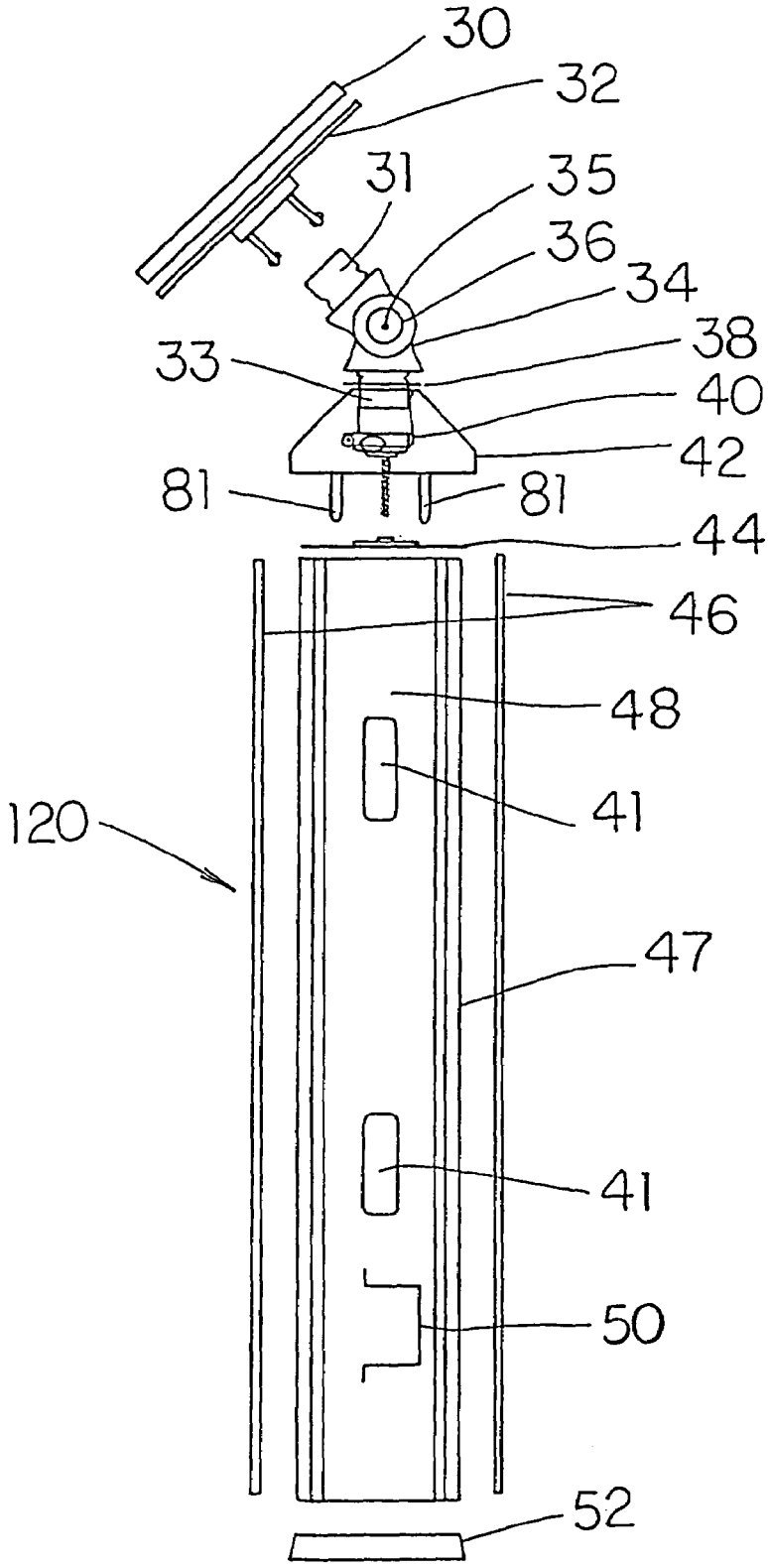
FIG. 12 is an assembly view of a solar powered perimeter beam tower according to the present invention.

FIG. 12 is a perspective view of the support rods 46 and the frame unit 47 secured to the base unit 52.

Figure 13:
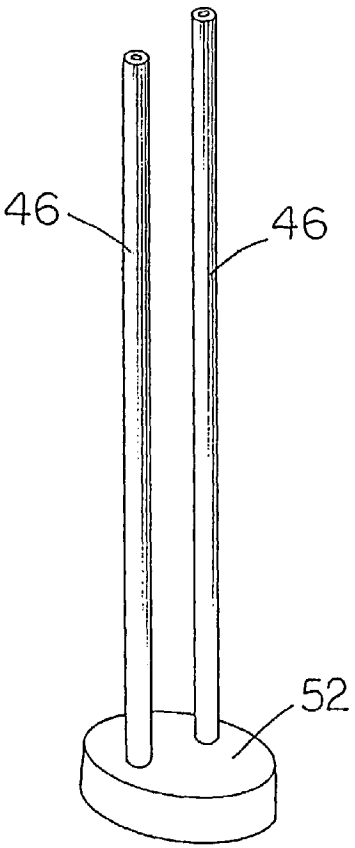
FIG. 13 is a perspective view of a tower housing base unit with support rods extending from the base unit.

FIG. 13 is a perspective view of a beam housing frame unit 47 being installed over the support rods 46.

Figure 14:
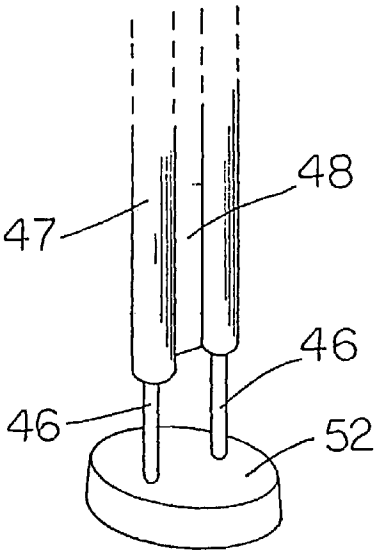
FIG. 14 is a partial perspective view of a tower housing base unit, support rods, and frame unit.

FIG. 14 is a top view in perspective of the frame unit 47 having face shield slots 58 and open channels 41 extending the length of the frame unit 47.

Figure 15:
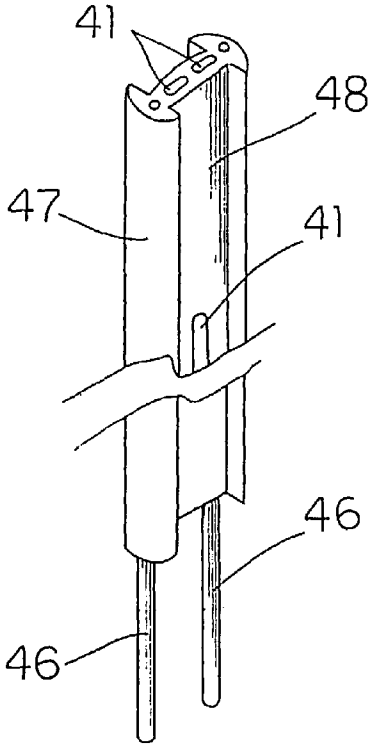
FIG. 15 is a perspective view of a tower housing frame unit inserted over support rods.

FIG. 15 is a perspective view of the beam housing clamping plate 44 being installed on top of the frame unit 47.

Figure 16:
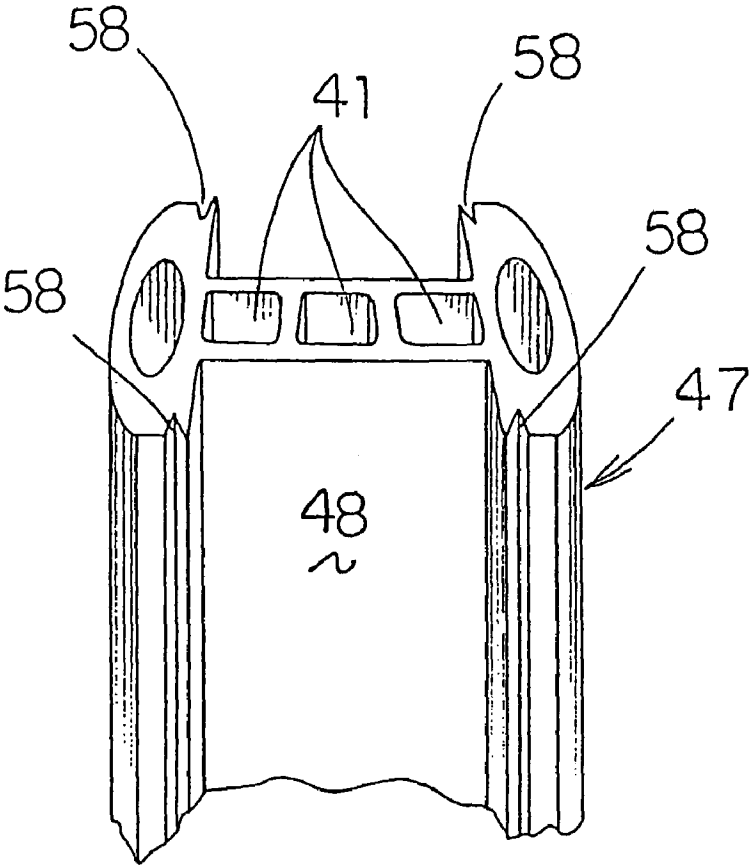
FIG. 16 is a perspective view of a top view of the tower frame unit prior to installation.

FIG. 16 is a perspective view of the beam housing frame 47 with opposing face shields 49 prior to installation in the face shield slots 58.

Figure 17:
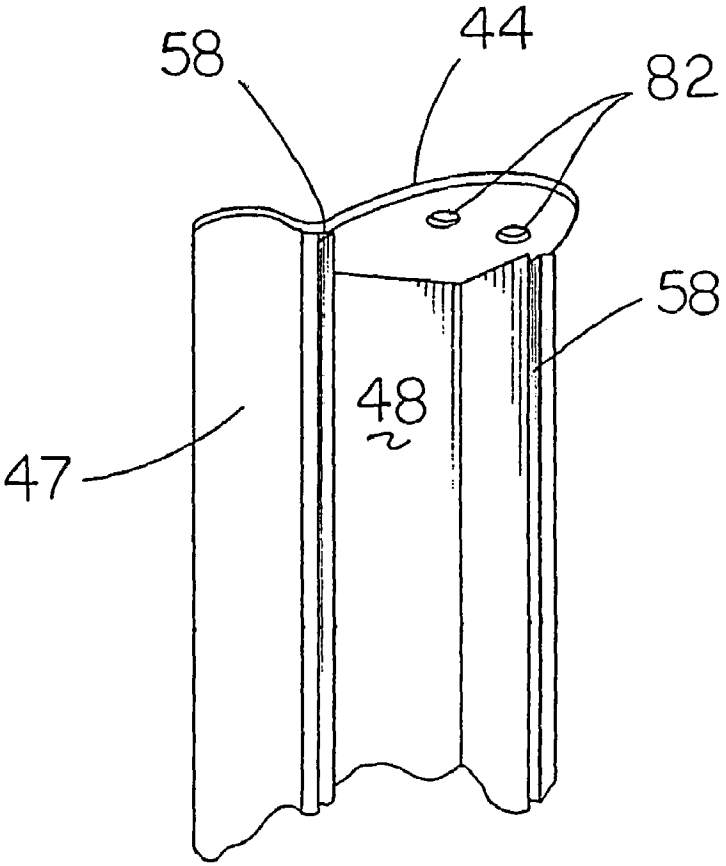
FIG. 17 is a perspective view of a clamping plate being installed upon the frame housing.
Figure 18:
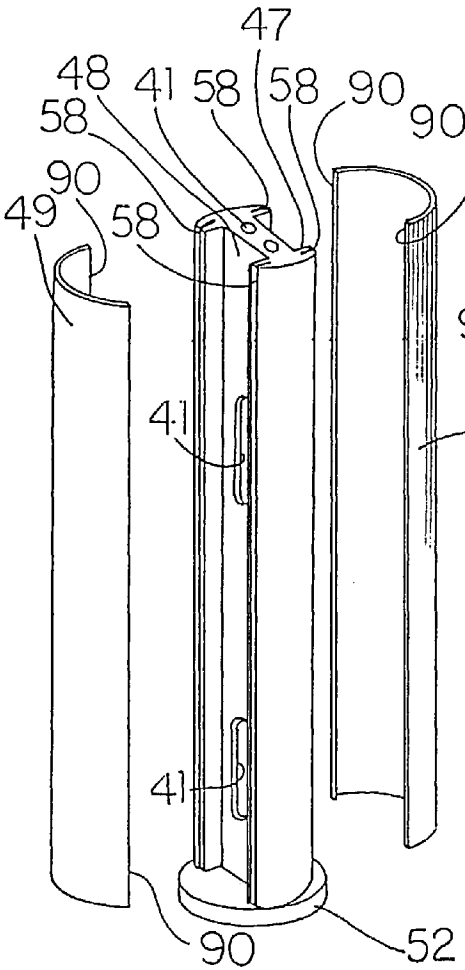
FIG. 18 is a perspective view of a perimeter beam tower during installation, showing a housing frame and opposing face shields.

FIG. 17 is a perspective view of the face shield installation process showing the face shield 49 on the right side installed, and the face shield 49 on the left side being installed. FIG. 18 is a perspective view of the face shield installation process of the face shield 49 on the right side of the figure. This view also shows the solar cap opening mechanism 40 atop the beam housing frame 47.

Figure 19:
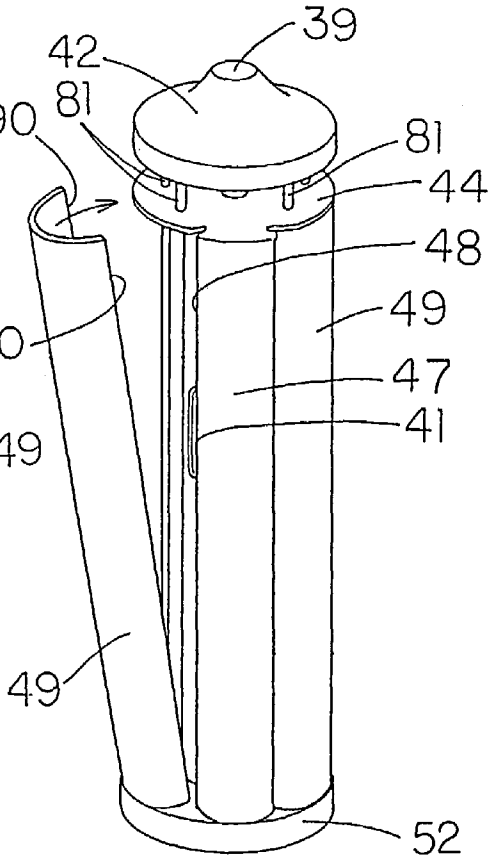
FIG. 19 is a perspective view of a face shield installation (left side) with a base cap positioned over alignment pins.

FIG. 19 is a perspective view of the solar base cap 42 and the swivel bracket O-ring 36 being installed atop the beam housing frame 47. A plurality of alignment pins 81 aid in securing the solar base cap 42 to the top of the beam housing frame 47.

Figure 20:
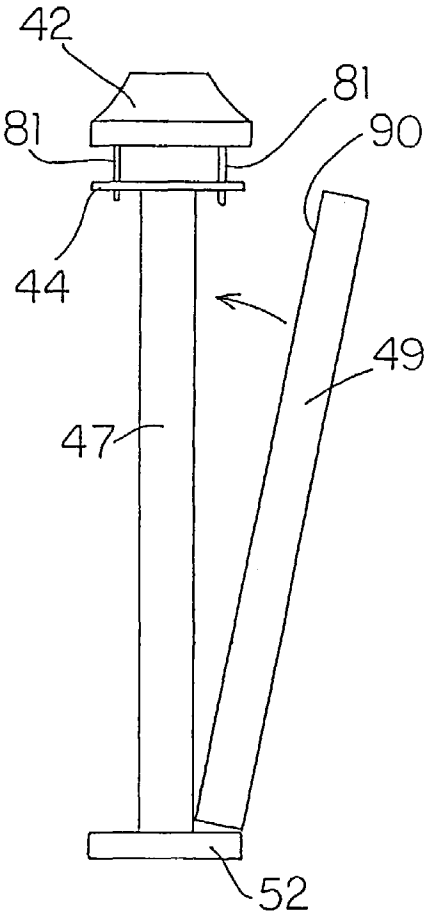
FIG. 20 is a perspective view of a perimeter beam tower showing a face shield installation (right side)

FIG. 20 is a perspective view of the solar cap opening mechanism 40 and the solar base cap 42, as seen from the underside thereof, showing the solar cap opening mechanism 40.

Figure 21:
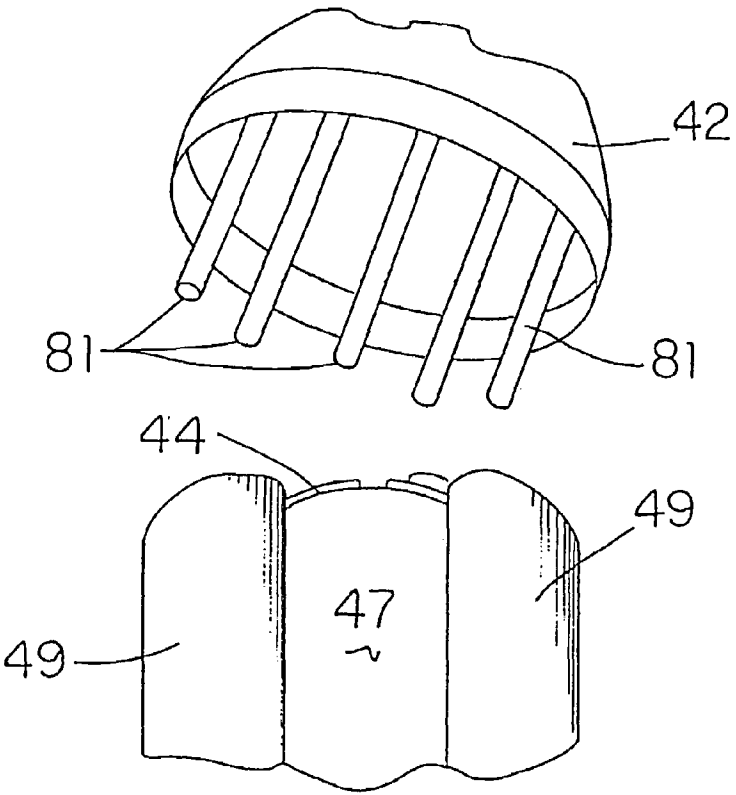
FIG. 21 is a perspective view of the top cap being installed upon the perimeter beam tower.

FIG. 21 is a perspective view of the solar panel 30 and solar mounting bracket 32, with the upper portion 31 of the swivel clamp 34 secured to the solar mounting bracket, and the lower portion of the swivel clamp 34 secured to the solar base cap 42. Where a solar panel 30 is not used, the top plate 44 may support a street light 62.

Figure 22:
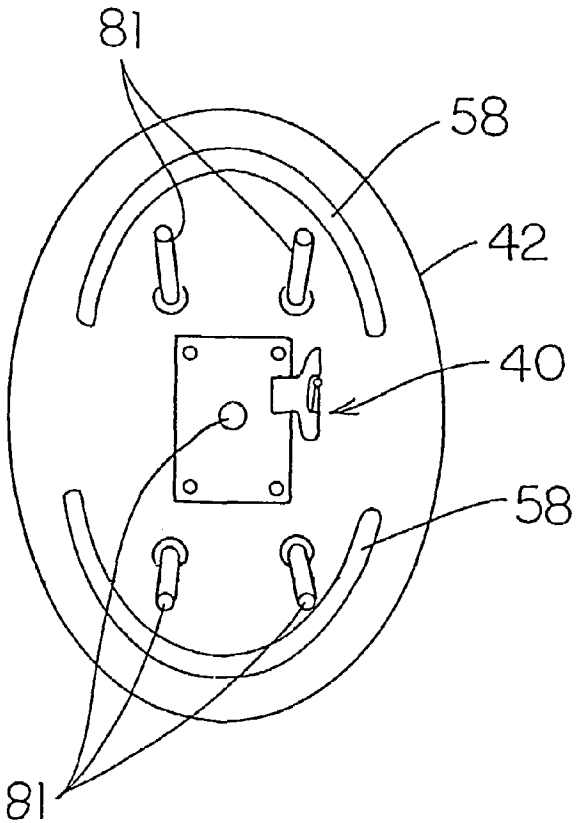
FIG. 22 is a bottom view of a solar cap and mechanism of FIG. 21.

FIG. 22 is a perspective view of the swivel clamp 34 adjustably secured together with a fastening means 35. A swivel O-ring 36 is positioned between the upper portion 31 and the lower portion 33 of the swivel clamp 34. A solar cap O-ring 38 is positioned between the lower portion 33 of the swivel clamp 34 and the swivel aperture 39 in the solar base cap 42.

Figure 23:
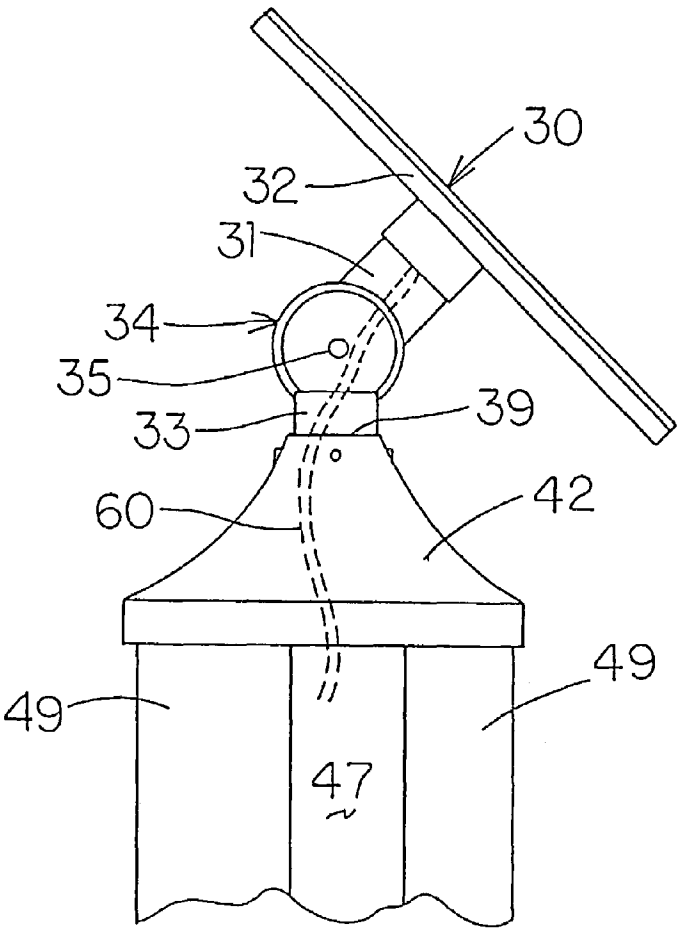
FIG. 23 is a perspective view of a solar cap, swivel bracket, and solar panel mounted upon the solar base cap of the perimeter beam tower.

FIG. 23 is an exploded view of a swivel clamp 34 showing the upper portion 31, the lower portion 33 and the swivel O-ring 36 shown assembled in FIG. 22.

Figure 24:
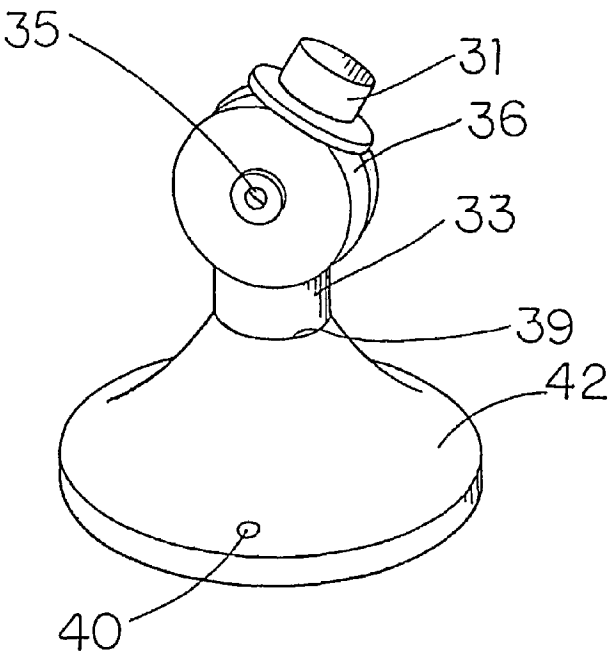
FIG. 24 is a perspective view of a swivel bracket mounted upon the solar base cap of the perimeter beam tower.

FIG. 24 is a perspective view of the assembled solar tower beam unit 120 with the solar panel 30 installed.

Figure 25:
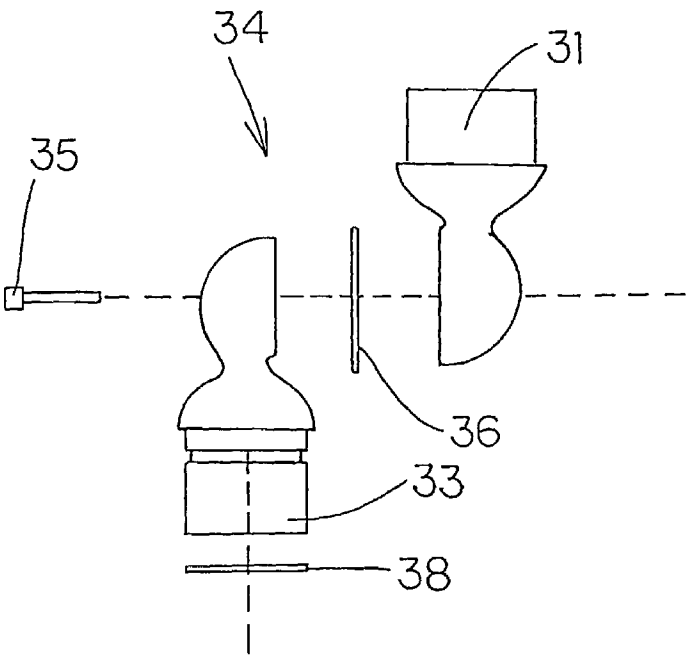
FIG. 25 is a breakaway view of the swivel bracket parts used in FIG. 24.

FIG. 25A, FIG. 25B, and FIG. 25C are selective views of the perimeter beam tower 120 with the face shields 49 removed, showing various electronic equipment mounted upon the frame unit 47.

Figure 26:
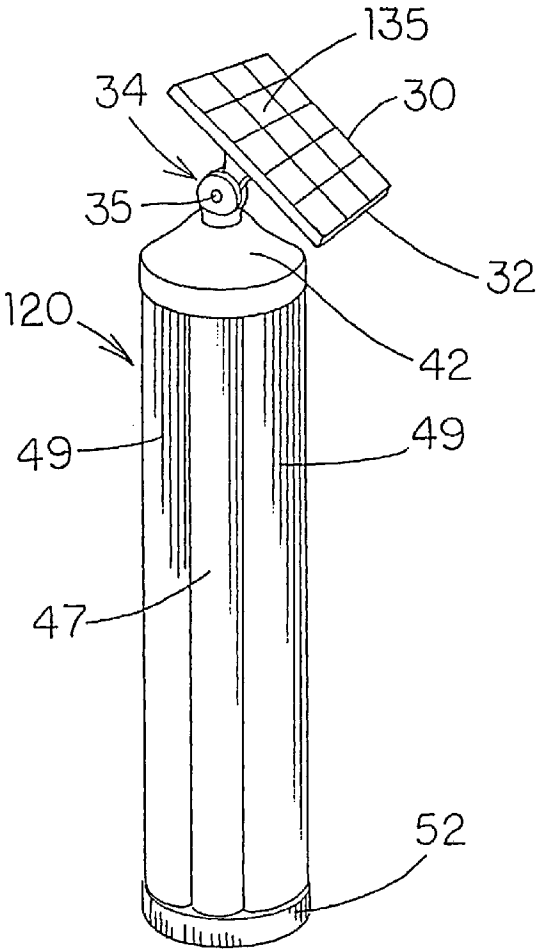
FIG. 26 is a perspective view of a complete perimeter beam tower with a solar panel mounted upon the top plate.

FIG. 26A is a diagram showing a single quad detector beam 56 extending between adjacent perimeter beam towers 120.

FIG. 26B is a diagram showing a single dual detector beam 56 extending between adjacent perimeter beam towers 120.

FIG. 26C is a diagram showing two dual detector beams 56 extending between adjacent perimeter beam towers 120.

FIG. 26D is a diagram showing multiple detector beams 56 extending between adjacent perimeter beam towers 120.

Figure 27C:
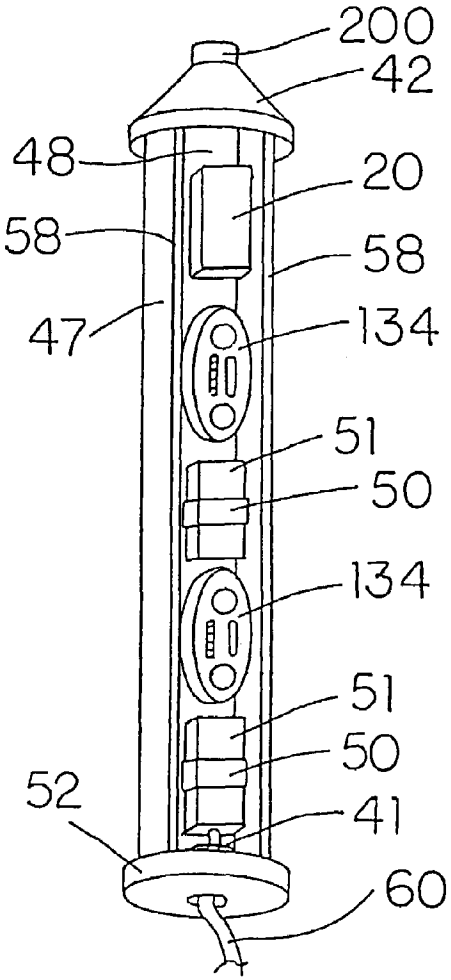
FIGS. 27A, 27B, and 27C are assembled views of the perimeter beam tower with a light mounted on the top.
Figure 27B:
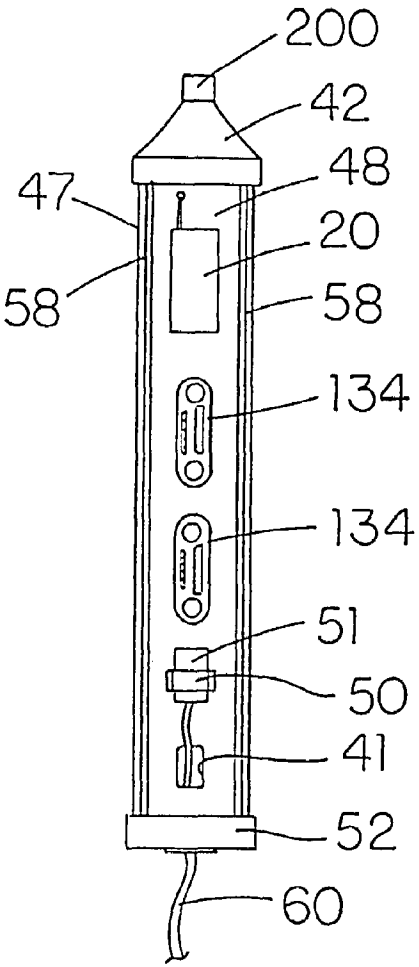
Figure 27A:
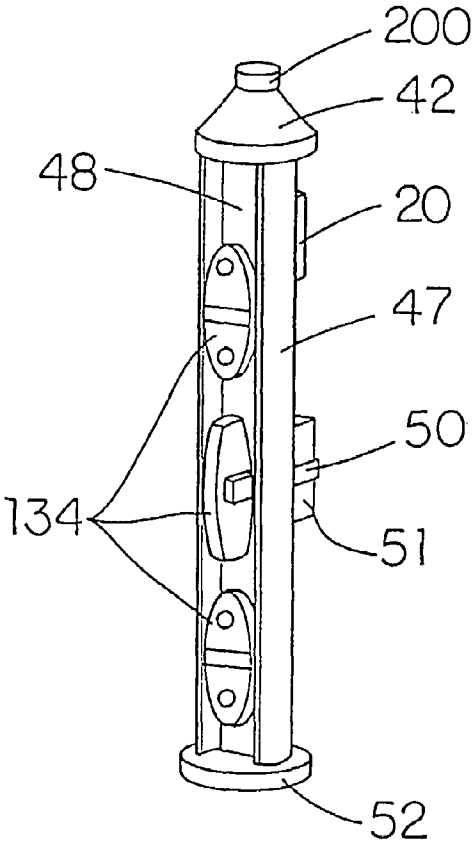
Figure 28A:
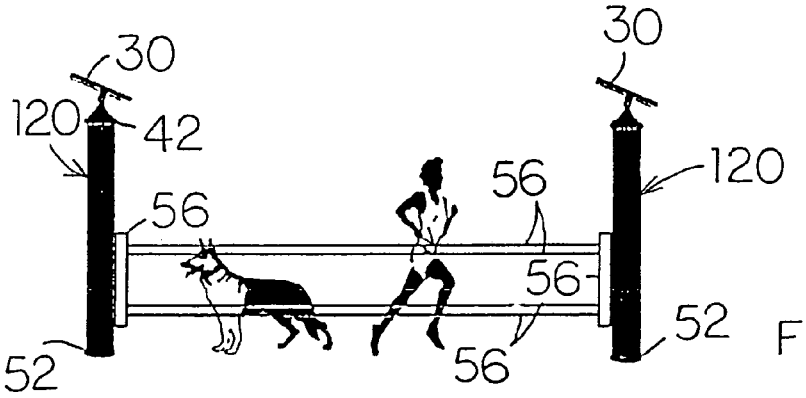
FIG. 28A is a diagram of the perimeter beam tower utilizing a point to point single quad detection beam.
Figure 28B:
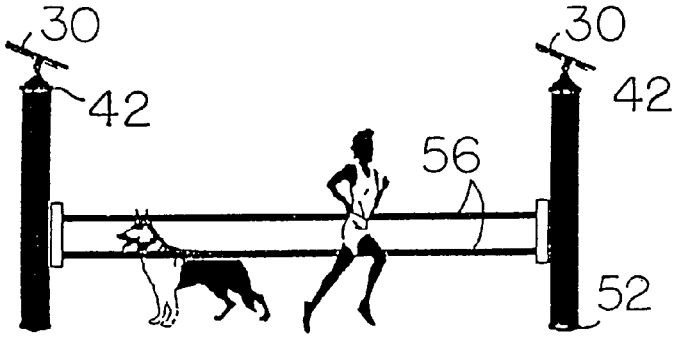
FIG. 28B is a diagram of the perimeter beam tower utilizing a point to point single dual detection beam.
Figure 28C:
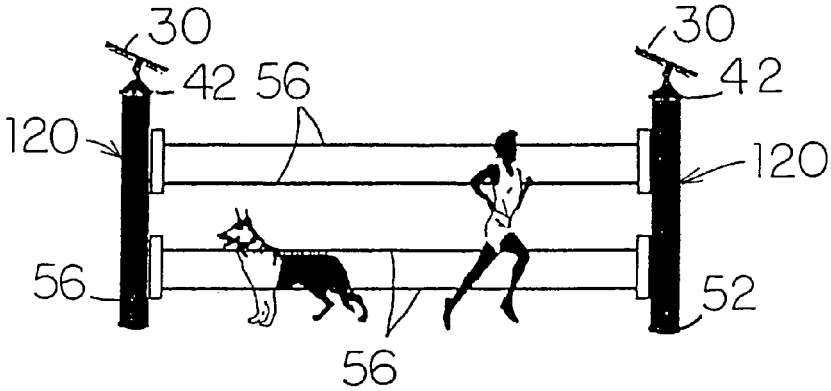
FIG. 28C is a diagram of the perimeter beam tower utilizing high/low point to point dual detection beams.
Figure 28D:
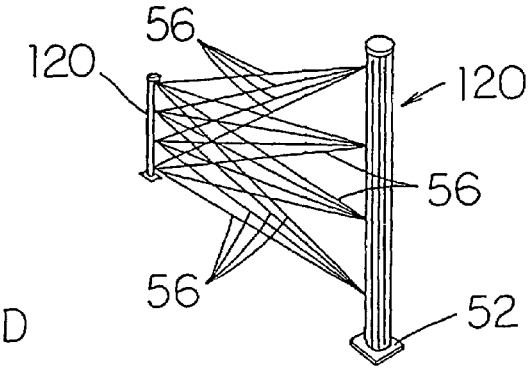
FIG. 28D is a diagram of the perimeter beam tower utilizing multiple detection beams.

FIG. 27A is a breakaway view of the perimeter beam tower 120, with a solar panel 30 attached.

FIG. 27B is a breakaway view of the perimeter beam tower 120 with a solar panel 30 attached.

FIG. 28 is a photograph showing several workers assembling a perimeter beam tower 120 wherein one of the face shields 49 has been removed to expose the electronic equipment mounted to the frame unit 47.

The invention being thus described, it will be evident that the same may be varied in many ways. Such variations are not to be regarded as a departure from the spirit and scope of the invention and all such modifications are intended to be included within the scope of the claims.

What is claimed is:

1. A solar powered perimeter beam security system comprising a plurality of spaced towers and a remote unit with an alarm, said towers each having one or more detection beams extending from one to another for detecting an intruder when at least one of said detection beams is interrupted, each of said towers including a transmitter and a receiver structured to perform two-way communication with the remote unit, and a solar panel, at least one of said towers being movable from one location to another, said detection beams defining an intruder detection area into which an intruder cannot pass without breaking at least one of said detection beams thereby setting off said alarm, said detection area being expandable and decreasable by moving said at least one of said towers; and wherein said remote unit includes a device configured to display information comprising the location of a breach in any of said detection beams, said information being initially communicated from said transmitter of said tower detecting said breach.

2. The security system of claim 1 wherein said at least one of said towers has means thereon for allowing movement of said at least one of said towers from one location to another location.

3. The security system of claim 2 wherein said means includes at least one axle and at least one wheel.

4. The security system of claim 2 wherein said means comprises at least three supports chosen from the group of supports consisting of wheels, rollers, skids, feet, and combinations thereof.

5. The security system of claim 1 wherein each group of three of said towers with their detection beams activated define a triangular intruder detection area, said intruder detection area either being of a triangular shape or of a geometric shape which consists of contiguous triangular intruder detection areas.

6. The security system of claim 5 wherein said intruder detection area is a multisided geometrical area defined by straight lines, said area being a plurality of contiguous triangular areas with a tower at each angle, each of said towers including a plurality of detection beam generators, a plurality of detection beam detectors, and a battery source in electrical communication with the solar panel for storage of energy generated by said solar panel, said battery source independently powering said receiver, said transmitter, said detection beam generators and said detection beam detectors at each of said towers.

7. The security system of claim 6 wherein said multisided area has the apex of all triangles being at the same location.

8. The security system of claim 6 wherein a single tower is at the apex of all triangular areas of said multisided area.

9. The security system of claim 1 wherein each of said towers includes at least one processor, at least one detection beam generator, and at least one detection beam detector thereon, each of said detectors and generators having at least one detection beam extending therefrom, each detection beam having a longitudinal axis extending between its generator and detector.

10. The security system of claim 9 wherein each of said detection beam detectors and detection beam generators are vertically, horizontally and angularly adjustable so as to be able to accurately position the location of said axis with regard to said detection beam detectors and detection beam generators of said plurality of towers.

11. The security system of claim 10 further comprising means for fixing the position of said detection beam detectors and generators once set whereby said adjustment cannot be changed without sounding said alarm.

12. The security system of claim 9 wherein each of said detection beam detectors and detection beam generators are adjustable to position said axes in the center of said detection beam detectors and detection beam generators and to vary the angles between each of said detection beams received, detected or generated by said towers.

13. The security system of claim 9 wherein said detection beam generator and said detection beam detector of each of the towers are vertically, horizontally and angularly fixed in each tower whereby any attempt to move said towers to change the position of said towers will set off an alarm.

14. The security system of claim 1 wherein the receiver and the transmitter of each of the towers is operable to communicate in duplex mode with said remote unit.

15. The security system of claim 14 wherein said remote unit is programmed to send a signal to the receiver and the transmitter of each of the towers to verify status, and to selectively actuate a remote controlled camera.

16. The system of claim 1, wherein said at least one detection beam comprises at least one of a photoelectric beam, an infrared beam, a laser beam, a microwave beam, and a visible light beam.

17. A perimeter beam tower for an intruder detection system having a plurality of set towers spaced apart about a perimeter and having detection beams extending therebetween for detection of an intruder, each of said towers communicating with a remote unit, each of said towers comprising (a) a base unit having means thereon for allowing said base unit to be moved from one position to another, (b) at least two support rods having upper and lower ends secured at said lower end to said base unit and extending upwardly therefrom, (c) a top plate secured to said upper end of said support rods, (d) a frame unit having a bottom portion of a height similar to the support rods, said frame unit slidably received over said support rods, said bottom portion of the frame unit being secured to said base unit, said frame unit having a face configured for mounting equipment thereto for use with the system and having opposing face shields slots extending between said base unit and said top plate, (e) opposing face shields of heights similar to the support rods, edges of each said face shields being inserted into a respective one of said face shields slots provided in said frame unit.

18. The perimeter beam tower of claim 17 wherein at least one beam generator is secured in vertical spaced alignment to said face of said frame unit, and multiple detection beams extend from one of said towers in said system to an adjacent tower in said system.

19. The perimeter beam tower of claim 17 further comprising a solar panel on each of said towers.

20. The perimeter beam tower of claim 17 further comprising an alarm connected to said remote unit and responsive to a breach in any of said detection beams.

21. The perimeter beam tower of claim 20 wherein said alarm comprises at least one of: an audible alarm, a visible alarm, telephone dialer, printer, a recording device, and combinations thereof.

22. The perimeter beam tower of claim 17 wherein said detection beams comprise at least one of: a photoelectric beam, an infrared beam, laser beam, microwave beam, a visible light beam.

23. The perimeter beam tower of claim 17 further comprising a receiver, a processor, and a transmitter, each of said receiver, processor and transmitter configured for radio communications between said towers and said remote unit.

24. The perimeter beam tower of claim 23 wherein said receiver and said processor have an antenna connected to said receiver and said processor and an indicator on which information on the location of any intrusion is displayed.

25. A system comprising:

a remote unit including a radio transmitter, a radio receiver, and an alarm; and two or more spaced apart towers each structured to provide one or more detection beams extending therebetween for detection of an intruder when at least one of the one or more detection beams is interrupted, each of the respective one of the two or more towers including:

a receiver, a processor, and a transmitter, configured for radio communications with said remote unit in a duplex mode;

one or more beam generators and one or more beam detectors; and a solar panel and a battery source in electrical communication with the solar panel to provide electrical energy to the receiver, the processor, the transmitter, the one or more beam generators, and the one or more beam detectors;

wherein said remote unit is structured to perform two-way wireless communication with each of the towers to verify operational status of the towers and activate the alarm if an intrusion is detected; and wherein the remote unit further includes a display device for displaying information comprising the location of the intrusion.

26. The system of claim 25, wherein at least one of the towers includes a camera remotely controlled by the remote unit.

27. The system of claim 25, wherein at least one of the towers includes a microphone and speaker unit.

28. The system of claim 25, wherein the two or more towers each of further includes a base unit moveable from one location to another and a frame secured to said base unit, said frame having a face configured for mounting equipment thereto for use with the system, wherein the solar panel is coupled to the frame by a swivel connection.

29. A system comprising:

a remote unit including a radio transmitter, a radio receiver, and an alarm; and two or more spaced apart towers each structured to provide one or more detection beams extending therebetween for detection of an intruder when at least one of the one or more detection beams is interrupted, each of the respective one of the two or more towers including:

a receiver, a processor, and a transmitter, configured for radio communications with said remote unit in a duplex mode;

one or more beam generators and one or more beam detectors; and a solar panel and a battery source in electrical communication with the solar panel to provide electrical energy to the receiver, the processor, the transmitter, the one or more beam generators, and the one or more beam detectors;

wherein said remote unit is structured to perform two-way wireless communication with each of the towers to verify operational status of the towers and activate the alarm if an intrusion is detected; and wherein the two way wireless communication includes means for reporting battery status to the remote unit from each of the two or more towers.

30. A solar powered perimeter beam security system comprising a plurality of spaced towers and a remote unit with an alarm, said towers each including a plurality of beam detectors and a plurality of beam detectors to provide multiple detection beams extending from one to another, the multiple beams between the towers being oriented to define an intruder detection area by beam interruption, each respective one of said towers including a respective one of a plurality of transmitters, a respective one of a plurality of processors, and a respective one of a plurality of receivers structured to perform two-way communication with the remote unit in a duplex mode, and further including a respective one of a plurality of solar panels connected to a battery to provide electric power to the respective one of said towers, at least one of said towers being movable from one location to another, said detection area being expandable and decreasable by moving said at least one of said towers, said remote unit being responsive to the two-way communication to activate an alarm when intrusion is detected with any of the towers; and wherein said remote unit is programmed to send a signal to said receivers, processors and transmitters of each of the towers to verify status, and to selectively actuate a remote controlled camera, to verify battery voltage, and to actuate a microphone and speaker unit connected thereto.

* * * * *